US008005387B2

(12) United States Patent
Nishiwaki et al.

(10) Patent No.: US 8,005,387 B2
(45) Date of Patent: Aug. 23, 2011

(54) APPARATUS FOR FORMING MULTI-COLOR IMAGE WITH CONTROL OF UNINTENDED REVERSE-TRANSFER OF DEVELOPER IMAGE ONTO PHOTOCONDUCTOR

(75) Inventors: Kenjiro Nishiwaki, Nagoya (JP); Toshio Furukawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/382,073

(22) Filed: Mar. 9, 2009

(65) Prior Publication Data

US 2009/0175640 A1 Jul. 9, 2009

Related U.S. Application Data

(60) Division of application No. 11/730,844, filed on Apr. 4, 2007, now abandoned, which is a continuation of application No. 10/951,865, filed on Sep. 29, 2004, now Pat. No. 7,215,898.

(30) Foreign Application Priority Data

Oct. 1, 2003 (JP) ..... 2003-343306

(51) Int. Cl.
*G03G 15/16* (2006.01)

(52) U.S. Cl. ..... 399/66; 399/149; 399/299

(58) Field of Classification Search ..... 399/66, 399/72, 299, 359, 296, 149, 150, 127, 128, 399/298

See application file for complete search history.

(56) References Cited

U.S. PATENT DOCUMENTS

| | | | | |
|---|---|---|---|---|
| 3,642,362 | A * | 2/1972 | Mueller | 399/312 |
| 4,162,843 | A | 7/1979 | Inoue et al. | |
| 5,600,421 | A | 2/1997 | Takekoshi et al. | |
| 5,627,629 | A | 5/1997 | Takahashi et al. | |
| 5,848,339 | A | 12/1998 | Costrop et al. | |
| 6,021,302 | A | 2/2000 | Janssens et al. | |
| 6,445,899 | B2 | 9/2002 | Sato | |
| 6,560,426 | B2 | 5/2003 | Sakaizawa | |
| 6,920,300 | B2 | 7/2005 | Watanabe et al. | |
| 7,593,675 | B2 * | 9/2009 | Kimura et al. | 399/296 |
| 2001/0010768 | A1 * | 8/2001 | Furuya et al. | 399/296 |

FOREIGN PATENT DOCUMENTS

| | | |
|---|---|---|
| JP | A-3-196172 | 8/1991 |
| JP | 06075484 A * | 3/1994 |
| JP | A-6-332321 | 12/1994 |
| JP | A-7-146597 | 6/1995 |
| JP | A-8-106197 | 4/1996 |
| JP | A-9-068844 | 3/1997 |

(Continued)

*Primary Examiner* — David Gray
*Assistant Examiner* — Laura Roth
(74) *Attorney, Agent, or Firm* — Oliff & Berridge, PLC

(57) ABSTRACT

An apparatus for forming a multi-color is disclosed which includes a controller that performs an anti reverse-transfer control such that a surface potential of a previously-formed separated-developer-image subset of a plurality of single-color separated-developer-images which has been previously transferred onto an image transferred medium is reduced, prior to a subsequent transfer in which a remainder of the plurality of separated-developer-images is transferred onto the image transferred medium after a previous transfer of the previously-formed separated developer-image subset onto the image transferred medium, to thereby prevent a reverse transfer of a part of a developer material on the image transferred medium from the image transferred medium onto a photoconductor at the subsequent transfer.

2 Claims, 12 Drawing Sheets

FOREIGN PATENT DOCUMENTS

| | | | | |
|---|---|---|---|---|
| JP | 10207166 | A | * | 8/1998 |
| JP | A-11-024366 | | | 1/1999 |
| JP | A-11-065305 | | | 3/1999 |
| JP | A-2000-181245 | | | 6/2000 |
| JP | A-2000-516349 | | | 12/2000 |
| JP | A-2001-051473 | | | 2/2001 |
| JP | A-2001-166556 | | | 6/2001 |
| JP | A-2001-290379 | | | 10/2001 |
| JP | A-2002-278214 | | | 9/2002 |
| JP | A-2003-048783 | | | 2/2003 |
| JP | A-2003-263006 | | | 9/2003 |

* cited by examiner 16
35
42
30
31
27
26
43
24
44
20
25
51
49
48
50
19
36
47
38
39
32a
37
46
59
40
23
22
32
41
28
52
29
45
34
33a
53
54
33
21
57
55
60
58
56
67
68

APPARATUS FOR FORMING MULTI-COLOR IMAGE WITH CONTROL OF UNINTENDED REVERSE-TRANSFER OF DEVELOPER IMAGE ONTO PHOTOCONDUCTOR

This is a Division of application Ser. No. 11/730,844 filed Apr. 4, 2007, which in turn is a Continuation of Ser. No. 10/951,865 filed Sep. 29, 2004, which claims the benefit of Japanese Patent Application No. 2003-343306 filed Oct. 1, 2003. The disclosures of the prior applications are hereby incorporated by reference herein in their entirety.

CROSS-REFERENCE TO RELATED APPLICATIONS

Not Applicable.

BACKGROUND OF THE INVENTION

1. Field of the Invention

The invention relates to an apparatus for forming a multi-color image by sequentially transferring single-color separated-developer-images from a photoconductor onto an image transferred medium for a superimposed registration of the separated-developer-images.

2. Description of the Related Art

There is known a color laser printer, for example, as one of apparatuses for each forming a multi-color image.

Typically, a color laser printer is operated, such that single-color separated-developer-images are formulated on a photoconductive drum functioning as a photoconductor, using respective different single-color toners functioning as developer materials, and such that these single-color separated-toner-images are electrically transferred in sequence onto an image transferred medium, such as a sheet of paper and an intermediate transfer belt, for a superimposed registration, resulting in a multi-color composite image formed on the image transferred medium.

Japanese Patent Publication No. 2001-166556 discloses such a type of color laser printer in which a photoconductor is provided respectively for each color, which is generally referred to in the art as "tandem type."

BRIEF SUMMARY OF THE INVENTION

As described above, such a color laser printer is operated such that each separated-toner-image is sequentially transferred onto the image transferred medium in superimposed registration.

During the process performed in such a color laser printer, a previous transfer is effected in which at least one previous separated-toner-image is transferred onto the image transferred medium, and then, a subsequent transfer is effected in which at least one subsequent separated-toner-image is transferred onto the same image transferred medium onto which the at least one previous separated image has been previously transferred.

In such a color laser printer, the subsequent transfer results in a charge up which means a raise in charge amount of the at least one previous separated-toner-image, and in turn results in a raise in charge amount of a resulting toner image deposited on the image transferred medium.

The larger the charge amount of a toner image on the image transferred medium, the more easily a reverse transfer of a toner from the image transferred medium to the photoconductive drum occurs at the aforementioned subsequent transfer in which the at least one subsequent separated-toner-image is to be transferred from the photoconductive drum to the image transferred medium.

Thus, a conventional color laser printer suffers from disadvantages due to the reverse transfer which would cause a deteriorated quality of a resultant toner image created on the image transferred medium.

It is therefore an object of the present invention to suppress a reverse-transfer of a developer material from an image transferred medium onto a photoconductor.

According to a first aspect of the present invention, there is provided an apparatus for forming a multi-color which includes a controller that performs an anti reverse-transfer control such that a surface potential of a previously-formed separated-developer-image subset of a plurality of single-color separated-developer-images which has been previously transferred onto an image transferred medium is reduced, prior to a subsequent transfer in which a remainder of the plurality of separated-developer-images is transferred onto the image transferred medium after a previous transfer of the previously-formed separated developer-image subset onto the image transferred medium, to thereby prevent a reverse transfer of a part of a developer material on the image transferred medium from the image transferred medium onto a photoconductor at the subsequent transfer.

In the apparatus according to the first aspect of the invention, the term "reverse transfer" is defined to mean such a phenomenon that a part of the developer material on the image transferred medium onto which the previously-formed separated-developer-image subset has been transferred, is reversely transferred onto the photoconductor. The reverse transfer occurs during a subsequent normal transfer of a subsequently-formed separated-developer-image subset of the plurality of single-color separated-developer-images from the photoconductor onto the image transferred medium.

Having studied the transfer of developer images between the photoconductor and the image transferred medium, the inventors found the fact that there is established a fixed relationship between the surface potential of a developer image which has been transferred to the image transferred medium, and the amount of a developer material which is reversely transferred from the image transferred medium to the photoconductor.

In view of the above findings, the inventors has reached an idea that the construction of an apparatus for creating an image to allow the surface potential of a developer image on the image transferred medium to fall within a range so predetermined as to suppress the aforementioned reverse transfer would result in suppression of the reverse transfer of a developer image from the image transferred medium to the photoconductor.

The apparatus according to the first aspect of the invention, which is provided in light of the above findings, as described above, would therefore contribute to reduction in reverse transfer of a developer image on the image transferred medium to the photoconductor. As a result, the apparatus would prevent deterioration in quality of a resultant toner image formulated on the image transferred medium.

According to a second aspect of the present invention, there is provided an apparatus for forming a multi-color image in which each developer unit disposed for each corresponding single-color developer material for developing each corresponding single-color separated-developer-image is configured to collect a residual of the each developer material which remains on the photoconductor after transfer of the each corresponding single-color separated-developer-image from the photoconductor onto the image transferred medium. The apparatus is of the type generally referred to in the art as "cleanerless."

As described above, the inventors have found the fact that there is established a fixed relationship between the surface potential of a developer image which has been transferred to the image transferred medium, and the amount of a developer material which is reversely transferred from the image transferred medium to the photoconductor.

In view of the above findings, the aforementioned apparatus according to the second aspect of the invention is further constructed such that a surface potential of a previously-formed separated-developer-image subset of a plurality of separated-developer-images which has been previously transferred onto an image transferred medium falls within a predetermined range.

More specifically, the surface potential is found on the image transferred medium at least one of selected times prior to and after a subsequent transfer in which a remainder of the plurality of separated-developer-images is transferred onto the image transferred medium after a previous transfer of the previously-formed separated developer-image subset onto the image transferred medium. The predetermined range is for suppressing a reverse transfer of a part of a developer material on the image transferred medium from the image transferred medium onto a photoconductor at the subsequent transfer.

The apparatus according to the second aspect of the invention, which is provided in light of the above findings, as described above, would therefore contribute to reduction in reverse transfer of a developer image on the image transferred medium to the photoconductor. As a result, the apparatus would prevent deterioration in quality of a resultant toner image on the image transferred medium.

In particular, in the case of a conventional apparatus for forming an image which is of the type of cleanerless, if a developer image should be reversely transferred from the image transferred medium to the photoconductor, each developer unit is caused to collect a developer material different in color from a developer material which has been originally stored in the instant developer unit, leading to a problem of a mix of developer materials having respective different colors.

By contrast, the apparatus according to the second aspect of the invention described above, since it enables suppression of a reverse transfer of a developer image from the image transferred medium to the photoconductor, would make it harder to introduce a mix of developer materials different in color, even though the aforementioned cleanerless type is employed.

According to a third aspect of the present invention, there is provided an apparatus for forming a multi-color image which includes a charge amount adjuster that reduces a charge amount of a previously-formed separated-developer-image subset of a plurality of separated-developer-images required to be sequentially transferred onto the image transferred medium for formation of the multi-color composite-developer-image, the previously-formed separated-developer-image subset having been previously transferred onto the photoconductor.

In the apparatus according to the third aspect of the invention, the charge amount of the previously-formed separated-developer-image subset is reduced by activation of the charge amount adjuster.

The apparatus according to the third aspect of the invention may be advantageous in use for suppressing a reverse transfer of a developer material from the image transferred medium to the photoconductor, for example.

According to a fourth aspect of the present invention, there is provided an apparatus for forming a multi-color image which includes:

a discharger that discharges at least one of a plurality of single-color separated-developer-images required to be sequentially transferred onto the image transferred medium for formation of the multi-color composite-developer-image, the at least one separated-developer-image having been transferred onto the photoconductor; and a charger that charges the at least one separated-developer-image upon discharging by the discharger.

In the apparatus according to the fourth aspect of the invention, a developer image on the image transferred medium, after being transferred to the image transferred medium, is discharged by the discharger, and subsequently, the same developer image is charged by the charger. The above apparatus would allow a desired adjustment of the surface potential of the developer image on the image transferred medium to fall within a desired range.

The apparatus according to the forth aspect of the invention may be advantageous in use for suppressing a reverse transfer of a developer material from the image transferred medium to the photoconductor, for example.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities show. In the drawings.

DETAILED DESCRIPTION OF THE INVENTION

Figure 1:
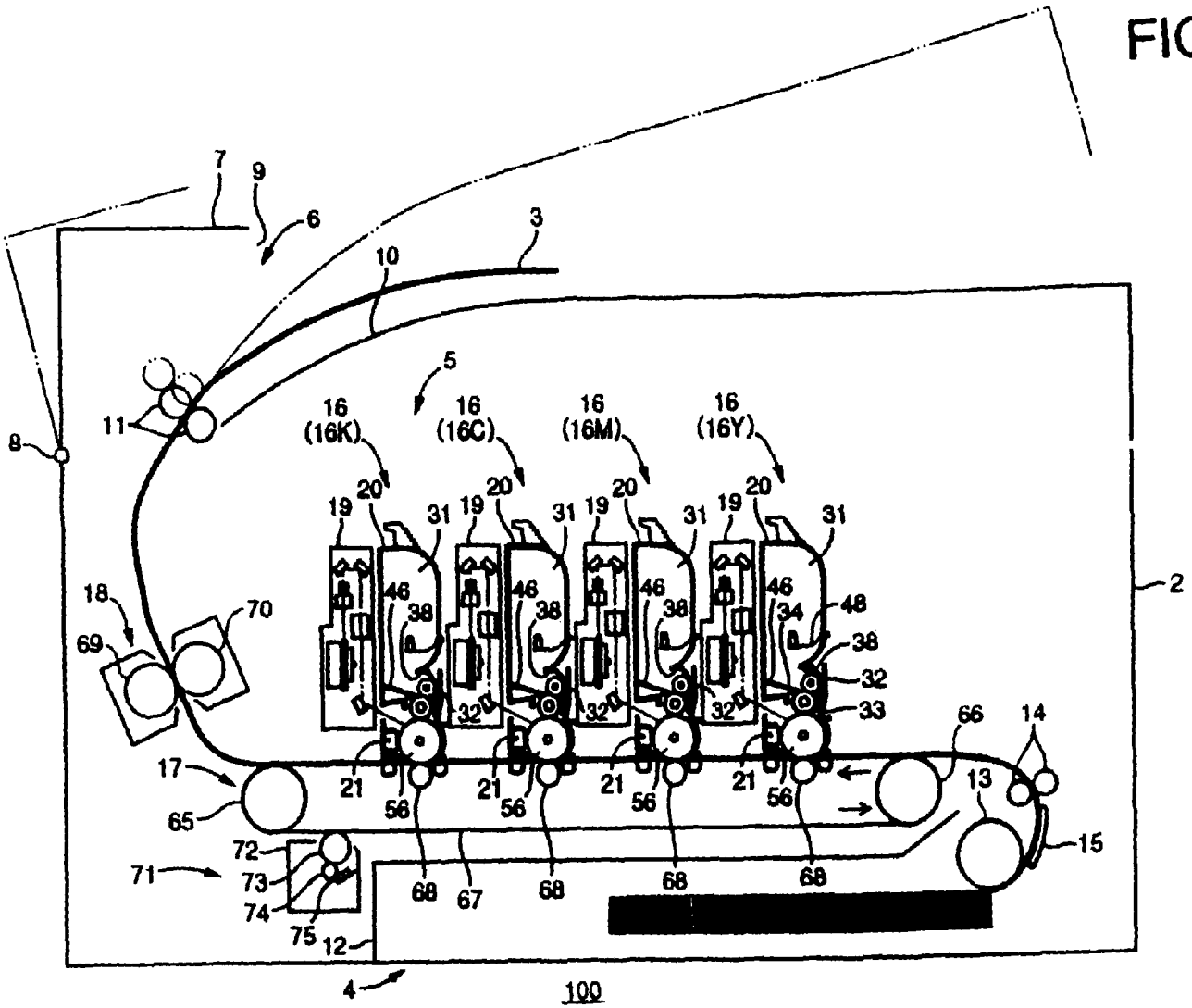
FIG. 1 is a cross-sectional side view illustrating a relevant portion of a color laser printer according to a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) An apparatus for forming a multi-color image, comprising:

a plurality of developer units that contain a plurality of single-color developer materials, respectively, the plurality of developer materials having respective different single colors;

a latent-image forming device that forms each latent image on a photoconductor, using each corresponding one of the plurality of developer materials that has been supplied from each corresponding one of the plurality of developer units;

a developer-image forming device that visualizes the each latent image which has been previously formed, into each corresponding single-color separated-developer-image, and that electrically transfers in sequence the each single-color separated-developer-image which has been previously formed, from the photoconductor onto an image transferred medium onto which the each single-color separated-developer-image is to be sequentially transferred, for a superimposed registration of a plurality of single-color separated-developer-images, to thereby form a multi-color composite-developer-image on the image transferred medium; and a controller that performs an anti reverse-transfer control such that a surface potential of a previously-formed separated-developer-image subset of a plurality of single-color separated-developer-images which has been previously transferred onto the image transferred medium is reduced, prior to a subsequent transfer in which a remainder of the plurality of separated-developer-images is transferred onto the image transferred medium after a previous transfer of the previously-formed separated developer-image subset onto the image transferred medium, to thereby prevent a reverse transfer of a part of the each developer material on the image transferred medium from the image transferred medium onto the photoconductor at the subsequent transfer.

The apparatus according to the above mode (1) would provide basically the same functions and results as the apparatus according to the above-described first aspect of the present invention.

(2) The apparatus according to mode (1), wherein the each developer unit is configured to collect a residual of the each developer material which remains on the photoconductor after transfer of the each corresponding single-color separated-developer-image from the photoconductor onto the image transferred medium.

The apparatus according to the above mode (2), since it enables suppression of a reverse transfer of a developer image from the image transferred medium to the photoconductor, would make it harder to introduce a mix of developer materials different in color, even though the aforementioned cleanerless type is employed.

(3) The apparatus according to mode (1) or (2), further comprising a surface potential sensor that detects the surface potential, and wherein the controller performs the anti reverse-transfer control, based on the surface potential detected by the surface potential sensor.

The apparatus according to the above mode (3) is constructed such that the surface potential is detected, and such that the anti reverse-transfer control is performed based on the detected surface, to thereby prevent a reverse transfer of a developer material from the image transferred medium to the photoconductor.

The apparatus according to the above mode (3) therefore would suppress a reverse transfer of a developer material from the image transferred medium to the photoconductor. In particular, the apparatus, since it is constructed so that the surface potential of a developer image formed on the image transferred medium can be detected, would stably suppress a reverse transfer of a developer material from the image transferred medium to the photoconductor, irrespective of variation in environmental conditions, such as temperature and humidity, deterioration with age in property of the present apparatus, etc.

(4) The apparatus according to any one of modes (1) through (3), wherein the controller is adapted to control the surface potential such that the surface potential falls within a predetermined range for suppressing the reverse transfer during implementation of the anti reverse-transfer control.

The apparatus according to the above mode (4) would allow a suitable suppression of the reverse transfer of the developer material from the image transferred medium to the photoconductor, because of the implementation of the anti reverse-transfer control to cause the surface potential of the developer image on the image transferred medium to fall within a predetermined range enabling the suppression of the reverse transfer.

(5) The apparatus according to mode (4), wherein the controller is adapted to control the surface potential prior to the subsequent transfer, such that the surface potential of a superimposed developer image on the image transferred medium falls within the predetermined range at an initiation time of the subsequent transfer.

The apparatus according to the above mode (5) would prevent a reverse transfer of a toner from the image transferred medium to the photoconductor during implementation of the subsequent transfer.

(6) The apparatus according to mode (4), wherein the controller is adapted to control the surface potential prior to the subsequent transfer, such that the surface potential of a superimposed developer image on the image transferred medium falls within the predetermined range at a termination time of the subsequent transfer.

The apparatus according to the above mode (6) would prevent a reverse transfer of a toner from the image transferred medium to the photoconductor after the subsequent transfer.

(7) The apparatus according to any one of modes (4) through (6), wherein the range is predetermined such that an absolute value of the surface potential does not exceed approximately 300 volts.

The apparatus according to the above mode (7) would suitably achieve the suppression of the reverse transfer of a developer material from the image transferred medium to the photoconductor (8) The apparatus according to any one of modes (4) through (6), wherein the range is predetermined such that an absolute value of the surface potential does not exceed approximately 250 volts.

The apparatus according to the above mode (8) would more suitably achieve the suppression of the reverse transfer of a developer material from the image transferred medium to the photoconductor (9) The apparatus according to any one of modes (1) through (8), wherein the controller is adapted to control a transfer bias applied to achieve a normal transfer of the each separated-developer-image from the photoconductor onto the image transferred medium, to thereby perform the anti reverse-transfer control.

The apparatus according to the above mode (9) is constructed such that the surface potential of the developer image on the image transferred medium is regulated because of a controlled transfer bias.

The apparatus according to the above mode (9) would therefore cause the surface potential of the developer image on the image transferred medium to fall within a predetermined range for allowing the suppression of the reverse transfer, without requiring an incorporation of any additional element into the construction of a conventional image forming apparatus.

(10) The apparatus according to any one of modes (1) through (8), wherein the controller is adapted to control a surface potential of the photoconductor, to thereby perform the anti reverse-transfer control.

The apparatus according to the above mode (10) is constructed such that the surface potential of the developer image on the image transferred medium is regulated because of the controlled surface potential of the photoconductor.

The apparatus according to the above mode (10) would therefore cause the surface potential of the developer image on the image transferred medium to fall within a predetermined range for allowing the suppression of the reverse transfer, without requiring an incorporation of any additional element into the construction of a conventional image forming apparatus, similarly with the apparatus according to the above mode (9).

(11) The apparatus according to any one of modes (1) through (10), further comprising a charge amount adjuster that reduces a charge amount of the previously-formed separated-developer-image subset which has been transferred onto the image transferred medium, and wherein the controller is adapted to reduce the surface potential via the charge amount adjuster, to thereby perform the anti reverse-transfer control.

The apparatus according to the above mode (11) is constructed such that the surface potential of the developer image on the image transferred medium is regulated by reduction in charge amount of the previously-formed separated-developer-image subset on the image transferred medium, the reduction being achieved by the charge amount adjuster.

The apparatus according to the above mode (11) would therefore achieve a more reliable reduction in surface potential of a developer image developed on the image transferred medium.

The apparatus according to the above mode (11), in order to adjust or regulate the surface potential of the developed developer image deposited on the image transferred medium, does not require a limited set-up of each factor of the present apparatus, such as a transfer bias and the surface potential of the photoconductor, allowing a more flexible system configuration.

(12) The apparatus according to mode (11), wherein the charge amount adjuster is of a corona discharge type including an ion generation electrode and a potential adjustment electrode in which a first bias is applied to the ion generation electrode, the first bias having a polarity opposite to that of the each separated-developer-image on the image transferred medium, while a second bias is applied to the potential adjustment electrode, the second bias having a polarity similar to that of the each separated-developer-image on the image transferred medium.

The apparatus according to the above mode (12) would enable the reduction in charge amount of the developer image on the image transferred medium to a value suitable to suppress the reverse transfer without varying the polarity of the developer image on the image transferred medium.

(13) The apparatus according to mode (11), wherein the charge amount adjuster, including a discharger and a charger, is adapted to cause the discharger to discharge the previously-formed separated-developer-image subset which has been transferred onto the image transferred medium, and subsequently causes the charger to charge the previously-formed separated-developer-image subset which has been transferred onto the image transferred medium to a potential, a polarity of which is similar to, and an absolute value of which is lower than, that of the previously-formed separated-developer-image subset found before discharging by the discharger, to thereby reduce the charge amount of the previously-formed separated-developer-image subset.

The apparatus according to the above mode (13) would allow the reduction in charge amount of the developer image on the image transferred medium to an optimum and fixed value.

(14) The apparatus according to any one of modes (3) through (13), wherein the surface potential sensor substitutes for the previously-formed separated-developer-image subset, a standardized developer image which has been standardized for use in the anti reverse-transfer control, and which has been transferred onto the image transferred medium, to thereby detect the surface potential of the standardized developer image, and wherein the multi-color composite-developer-image is formed on a recording medium after the each separated-developer-image has been sequentially transferred onto the recording medium.

The apparatus according to the above mode (14) is constructed such that the surface potential of the standardized developer image is detected, and such that the anti reverse-transfer control is performed based on the detected surface potential.

The apparatus according to the above mode (14) would therefore enable the anti reverse-transfer control to be stably implemented, irrespective of the size of an informational area, i.e., an area representing a content, of a diverse developer image which the user wishes to be transferred onto the image transferred medium, with the achievement of the same effects of the apparatus according to the above mode (1).

That is to say, even if an informational area of a developer image which the user wishes to be formed is not large enough to allow an intended detection of the surface potential of the developer image, the apparatus according to the above mode (14) would enable the detection of the surface potential using instead the standardized developer image.

(15) The apparatus according to mode (14), wherein the image transferred medium is a recording medium to be transported via a transport belt, wherein the standardized developer image has been transferred onto the transport belt for use in the anti reverse-transfer control, and wherein the controller performs the anti reverse-transfer control, based on the surface potential of the standardized developer image detected by the surface potential sensor.

In the apparatus according to the above mode (15), the standardized developer image is transferred onto the transport belt, and the anti reverse-transfer control is performed based on the detected surface potential of the standardized developer image. The apparatus would provide basically the same functions and results as the apparatus according to the above mode (14).

(16) The apparatus according to mode (14), wherein the image transferred medium is an intermediate transfer belt onto which the each separated-developer-image is to be transferred, wherein the each separated-developer-image is transferred from the intermediate transfer belt onto the recording medium, wherein the standardized developer image has been transferred onto the intermediate transfer belt, and wherein the controller performs the anti reverse-transfer control, based on the surface potential of the standardized developer image detected by the surface potential sensor.

In the apparatus according to the above mode (16), the standardized developer image is transferred onto the intermediate transfer belt, and the anti reverse-transfer control is performed based on the detected surface potential of the standardized developer image. The apparatus would provide basically the same functions and results as the apparatus according to the above mode (14).

(17) The apparatus according to any one of modes (1) to (16), wherein the controller performs the anti reverse-transfer control, in parallel with an image formation operation in which the each separated-developer-image is sequentially transferred onto a recording medium for formation of the multi-color composite-developer-image.

An example of the apparatus according to the above mode (17) may be practiced such that the anti reverse-transfer is performed for each respective image-formation-operation in each corresponding adaptive manner dependent on peripheral conditions such as environmental conditions. This example results in a suitable prevention of the reverse transfer irrespective of variation in the peripheral conditions.

(18) The apparatus according to any one of modes (1) to (16), wherein the controller performs the anti reverse-transfer control, under a predetermined initiation condition, not in parallel with an image formation operation in which the each separated-developer-image is sequentially transferred onto a recording medium for formation of the multi-color composite-developer-image.

An example of the apparatus according to the above mode (18) may be practiced such that the anti reverse-transfer is limitedly performed at least at the time critical to the present apparatus, such as the time that the present apparatus is powered on. This example would allow savings including such as a saving of a developer material, for example.

(19) An apparatus for forming a multi-color image, comprising:

a plurality of developer units that contain a plurality of single-color developer materials, respectively, the plurality of developer materials having respective different single colors;

a latent-image forming device that forms each latent image on a photoconductor, using each corresponding one of the plurality of developer materials that has been supplied from each corresponding one of the plurality of developer units; and a developer-image forming device that visualizes the each latent image which has been previously formed, into each corresponding single-color separated-developer-image, and that electrically transfers in sequence the each single-color separated-developer-image which has been previously formed, from the photoconductor onto an image transferred medium onto which the each single-color separated-developer-image is to be sequentially transferred, for a superimposed registration of a plurality of single-color separated-developer-images, to thereby form a multi-color composite-developer-image on the image transferred medium, wherein the each developer unit is configured to collect a residual of the each developer material which remains on the photoconductor after transfer of the each corresponding single-color separated-developer-image from the photoconductor onto the image transferred medium, and wherein a surface potential of a previously-formed separated-developer-image subset of a plurality of separated-developer-images which has been previously transferred onto the image transferred medium, the surface potential being found on the image transferred medium at at least one of selected times prior to and before a subsequent transfer in which a remainder of the plurality of separated-developer-images is transferred onto the image transferred medium after a previous transfer of the previously-formed separated developer-image subset onto the image transferred medium, falls within a predetermined range for suppressing a reverse transfer of a part of the each developer material on the image transferred medium from the image transferred medium onto the photoconductor at the subsequent transfer.

The apparatus according to the above mode (19) would provide basically the same functions and results as the apparatus according to the above-described second aspect of the present invention.

(20) The apparatus according to mode (19), wherein the range is predetermined such that an absolute value of the surface potential does not exceed approximately 300 volts.

The apparatus according to the above mode (20) would suitably achieve the suppression of the reverse transfer of a developer material from the image transferred medium to the photoconductor

(21) The apparatus according to mode (19), wherein the range is predetermined such that an absolute value of the surface potential does not exceed approximately 250 volts.

The apparatus according to the above mode (21) would more suitably achieve the suppression of the reverse transfer of a developer material from the image transferred medium to the photoconductor

(22) The apparatus according to any one of modes (19) to (21), wherein a transfer bias applied for a normal transfer of the each separated-developer-image from the photoconductor onto the image transferred medium is set to a value for allowing the surface potential of the previously-formed separated-developer-image subset which has been transferred onto the image transferred medium, to fall within the range.

The apparatus according to the above mode (22) is constructed such that the surface potential of the developer image on the image transferred medium is regulated because of the set value of the transfer bias.

The apparatus would therefore cause the surface potential of the developer image on the image transferred medium to fall within a predetermined range for allowing the suppression of the reverse transfer, without requiring an incorporation of any additional element into the construction of a conventional image forming apparatus.

(23) The apparatus according to any one of modes (19) to (21), wherein a surface potential of the photoconductor is set to a value for allowing the surface potential of the previously-formed separated-developer-image subset which has been transferred onto the image transferred medium, to fall within the range.

The apparatus according to the above mode (23) is constructed such that the surface potential of the developer image on the image transferred medium is regulated because of the set value of the surface potential of the photoconductor.

The apparatus according to the above mode (23) would therefore cause the surface potential of the developer image on the image transferred medium to fall within a predetermined range for allowing the suppression of the reverse transfer, without requiring an incorporation of any additional element into the construction of a conventional image forming apparatus, similarly with the apparatus according to the above mode (22).

(24) The apparatus according to any one of modes (19) to (21), wherein an amount of the each developer material which is to be affixed to the photoconductor for formation of a reference image is set to a value for allowing the surface potential of the previously-formed separated-developer-image subset which has been transferred onto the image transferred medium, to fall within the range.

In the apparatus according to the above mode (24), the "amount of the each developer material which is to be affixed to the photoconductor for formation of a reference image" is expressed as a mass of a developer material which is used per unit area for forming of an image.

The apparatus according to the above mode (24) is constructed such that the surface potential of the developer image on the image transferred medium is regulated because of the adjustment of the amount of the developer material to be affixed to the photoconductor for forming the reference image. The amount of the developer material to be affixed may be adjusted depending upon the kind of the developer material employed.

The apparatus according to the above mode (24) would therefore cause the surface potential of the developer image on the image transferred medium to fall within a predetermined range for allowing the suppression of the reverse transfer, without requiring an incorporation of any additional element into the construction of a conventional image forming apparatus, similarly with the apparatus according to the above mode (22) or (23).

(25) The apparatus according to any one of modes (19) to (21), further comprising a charge amount adjuster that reduces a charge amount of the previously-formed separated-developer-image subset which has been transferred onto the image transferred medium, to thereby allow the surface potential of the previously-formed separated-developer-image subset which has been transferred onto the image transferred medium, to fall within the range.

The apparatus according to the above mode (25) is constructed such that the surface potential of the developer image on the image transferred medium is regulated by the reduction in charge amount of the previously-formed separated-developer-image subset on the image transferred medium, the reduction being achieved by the charge amount adjuster.

The apparatus according to the above mode (25) would therefore achieve a more reliable suppression of the surface potential of a developer image developed on the image transferred medium.

The apparatus according to the above mode (25), in order to adjust or regulate the surface potential of the developed developer image deposited on the image transferred medium, does not require a limited set-up of each factor of the present apparatus, such as a transfer bias and the surface potential of the photoconductor, allowing a more flexible system configuration.

(26) The apparatus according to mode (25), wherein the charge amount adjuster is of a corona discharge type including an ion generation electrode and a potential adjustment electrode in which a first bias is applied to the ion generation electrode, the first bias having a polarity opposite to that of the each separated-developer-image on the image transferred medium, while a second bias is applied to the potential adjustment electrode, the second bias having a polarity similar to that of the each separated-developer-image on the image transferred medium, and having a magnitude allowing the surface potential to fall within the range.

The apparatus according to the above mode (25) would enable the reduction in charge amount of the developer image on the image transferred medium to a value suitable to suppress the reverse transfer without any change in polarity of the developer image on the image transferred medium.

(27) The apparatus according to mode (25), wherein the charge amount adjuster, including a discharger and a charger, causes the discharger to discharge the previously-formed separated-developer-image subset which has been transferred onto the image transferred medium, and subsequently causes the charger to charge the previously-formed separated-developer-image subset which has been transferred onto the image transferred medium to a potential, a polarity of which is similar to, and an absolute value of which is lower than, that of the previously-formed separated-developer-image subset found before discharging by the discharger, whereby the charge amount of the previously-formed separated-developer-image subset is reduced.

The apparatus according to the above mode (27) would allow the reduction in charge amount of the developer image on the image transferred medium to an optimum and fixed value.

(28) An apparatus for forming a multi-color image, comprising:

a plurality of developer units that contain a plurality of single-color developer materials, respectively, the plurality of developer materials having respective different single colors;

a latent-image forming device that forms each latent image on a photoconductor, using each corresponding one of the plurality of developer materials that has been supplied from each corresponding one of the plurality of developer units;

a developer-image forming device that visualizes the each latent image which has been previously formed, into each corresponding single-color separated-developer-image, and electrically transfers in sequence the each single-color separated-developer-image which has been previously formed, from the photoconductor onto an image transferred medium onto which the each single-color separated-developer-image is to be sequentially transferred, for a superimposed registration of a plurality of single-color separated-developer-images, to thereby form a multi-color composite-developer-image on the image transferred medium; and a charge amount adjuster that reduces a charge amount of a previously-formed separated-developer-image subset of a plurality of separated-developer-images required to be sequentially transferred onto the image transferred medium for formation of the multi-color composite-developer-image, the previously-formed separated-developer-image subset having been previously transferred onto the photoconductor.

The apparatus according to the above mode (28) would provide basically the same functions and results as the apparatus according to the above-described third aspect of the present invention.

(29) The apparatus according to mode (28), wherein the charge amount adjuster is of a corona discharge type including an ion generation electrode and a potential adjustment electrode in which a first bias is applied to the ion generation electrode, the first bias having a polarity opposite to that of the each separated-developer-image on the image transferred medium, while a second bias is applied to the potential adjustment electrode, the second bias having a polarity similar to that of the each separated-developer-image on the image transferred medium, and having a magnitude allowing the surface potential to fall within the range.

The apparatus according to the above mode (29) would enable the reduction in charge amount of the developer image on the image transferred medium to a value suitable to suppress the reverse transfer without any change in polarity of the developer image on the image transferred medium.

(30) The apparatus according to mode (28), wherein the charge amount adjuster, including a discharger and a charger, causes the discharger to discharge the previously-formed separated-developer-image subset which has been transferred onto the image transferred medium, and subsequently causes the charger to charge the previously-formed separated-developer-image subset which has been transferred onto the image transferred medium to a potential, a polarity of which is similar to, and an absolute value of which is lower than, that of the previously-formed separated-developer-image subset found before discharging by the discharger, whereby the charge amount of the previously-formed separated-developer-image subset is reduced.

The apparatus according to the above mode (30) would enable the reduction in charge amount of the developer image on the image transferred medium to a value suitable to suppress the reverse transfer without varying the polarity of the developer image on the image transferred medium.

(31) An apparatus for forming a multi-color image, comprising:

a plurality of developer units that contain a plurality of single-color developer materials, respectively, the plurality of developer materials having respective different single colors;

a latent-image forming device that forms each latent image on a photoconductor, using each corresponding one of the plurality of developer materials that has been supplied from each corresponding one of the plurality of developer units;

a developer-image forming device that visualizes the each latent image which has been previously formed, into each corresponding single-color separated-developer-image, and that electrically transfers in sequence the each single-color separated-developer-image which has been previously formed, from the photoconductor onto an image transferred medium onto which the each single-color separated-developer-image is to be sequentially transferred, for a superimposed registration of a plurality of single-color separated-developer-images, to thereby form a multi-color composite-developer-image on the image transferred medium;

a discharger that discharges at least one of a plurality of single-color separated-developer-images required to be sequentially transferred onto the image transferred medium for formation of the multi-color composite-developer-image, the at least one separated-developer-image having been transferred onto the photoconductor; and a charger that charges the at least one separated-developer-image upon discharging by the discharger.

The apparatus according to the above mode (31) would provide basically the same functions and results as the apparatus according to the above-described fourth aspect of the present invention.

Several presently preferred embodiments of the invention will be described in detail by reference to the drawings in which like numerals are used to indicate like elements throughout.

FIG. 1 is a side cross-sectional view showing a relevant portion of a color laser printer 100 which functions as an image forming apparatus according to a first embodiment of the present invention.

As shown in FIG. 1, the color laser printer 100 is of the type referred to in the art as "horizontal tandem type" in which four processing devices 16 are parallelly juxtaposed in the horizontal direction. A body casing 2 of the color laser printer 100, which functions as the body of an image forming apparatus, is configured to include a feeder section 4 for feeding a sheet 3 of paper (recording medium); an image forming section 5 for forming an image on a sheet 3 of paper which has been fed; and an exit section 6 for ejecting a sheet 3 of paper on which an image has been formed.

The body casing 2 is generally shaped as a rectangular box being open at the top the box when viewed laterally, and is provided with a top cover 7 in the top of the body casing 2. The top cover 7 is pivotly supported at the rear side of the body casing 2 (hereinafter, the left hand side of FIG. 1 will be referred to as the "rear side," and the right hand side of FIG. 1 as the "front side"), enabling the top cover 7 to be freely opened and closed as indicated by the phantom lines (the two-dotted chain lines) in FIG. 1.

The top cover 7 includes; a paper exit 9 for ejecting a sheet 3 of paper; an exit tray 10 which is lowered at the paper exit 9 for a stack of sheets 3 of paper which have been ejected from the paper exit 9; and an exit roller 11 which is disposed in the paper exit 9 at the rear end of the exit tray 10. The paper exit 9, the exit tray 10, and the exit roller 11 move together with the top cover 7 in response to open and close actions of the top cover 7.

The feeder section 4 is disposed within the bottom of the body casing 2 and includes; a feeder tray 12 inserted from the front side of the body casing 2 into the inside of the body casing 2, for a detachable attachment in the horizontal direction; a feeder roller 13 that is disposed above the front portion of the feeder tray 12; and transport rollers 14,14 disposed above the feeder roller 13 downstream from the feeder roller 13 along a travel path of a sheet 3 of paper.

In the feeder tray 12, a plurality sheets 3 of paper are stacked, the uppermost one of which is fed toward the transport rollers 14,14, sheet by sheet, as a result of rotation of the feeder roller 13, and is then fed from the transport rollers 14,14 to a position between a transport belt 67 and each respective photoconductive drum 56 (transfer position).

Between the feeder roller 13 and the transport rollers 14,14, a guide member 15 is disposed extending vertically. The guide member 15 is adapted to guide a sheet 3 of paper which has been fed via the feeder roller 13, for transport to the transport rollers 14,14, and to subsequently transport the sheet 3 to the aforementioned transfer position between the transport belt 67 and the each respective photoconductive drum 56, both of which are located rearward from the transport rollers 14,14 along the travel path.

The image forming section 5 includes: the processing devices 16; a transfer device 17; and a fusing device 18. The processing devices 16 are provided respectively for a plurality of different color toners that form respective components of a multi-color image. For the color laser printer 100, the processing devices 16 are configured to include four of a yellow processing device 16Y; a magenta processing device 16M; a cyan processing device 16C; and a black processing device 16K.

Each processing device 16 includes: a scanner unit 19; a developer unit 20; and a photoconductive-drum unit 21. Each developer unit 20, which is respectively detachably attached to the body casing 2 respectively for each corresponding color, includes within a developer casing 30 of the each developer unit 20: a toner storage 31; a supply roller 32; a developer roller 33; and a thickness-regulating blade 34.

Figure 2:
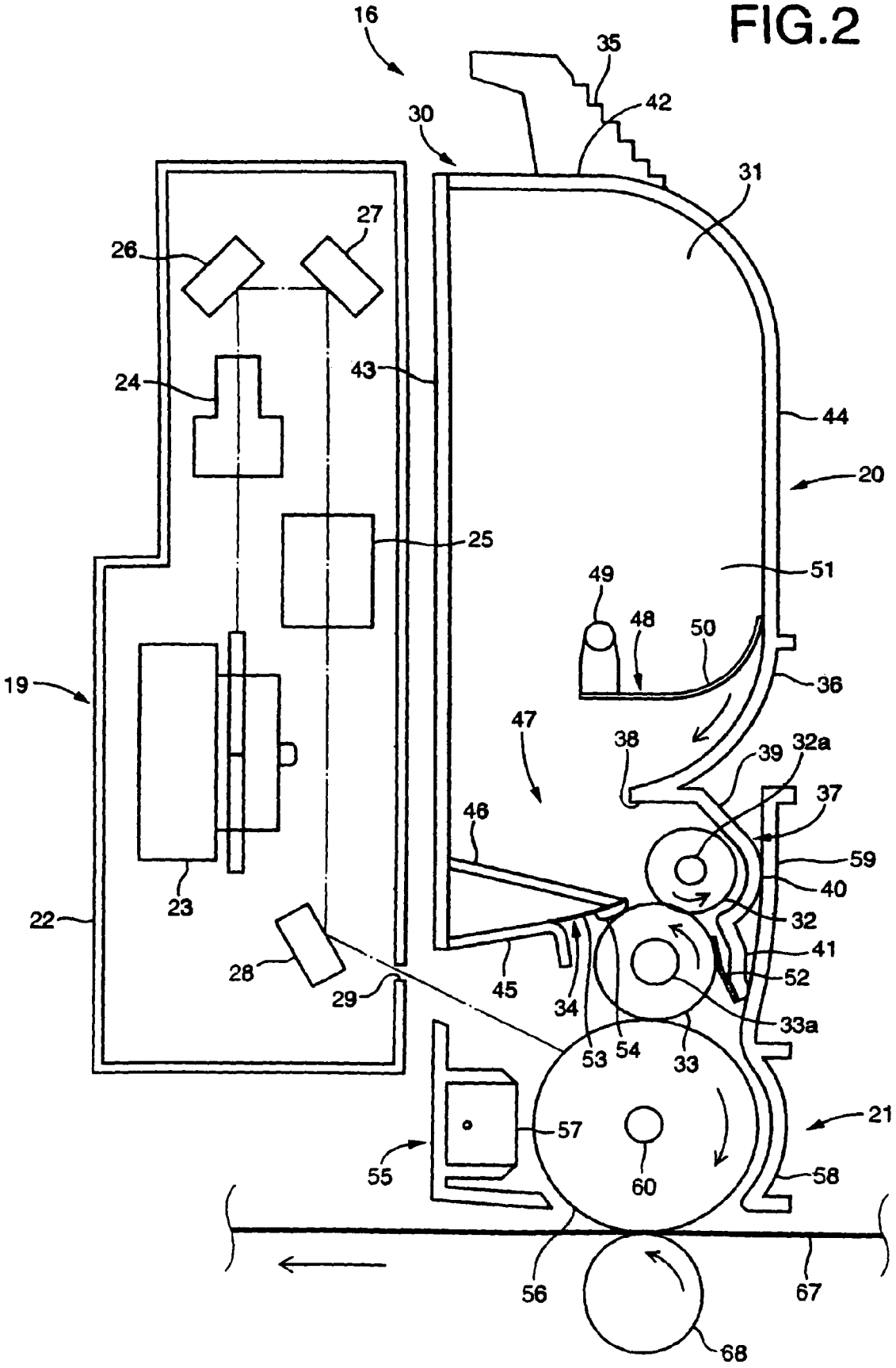
FIG. 2 is a cross-sectional side view illustrating a relevant portion of each of processing devices included in the color laser printer shown in FIG. 1.

As shown in FIG. 2, the developer casing 30, which is shaped as an elongated box being open at the bottom thereof, includes at a top wall 42 thereof a gripper 35 enabling the user to grip the developer casing 30 during the user attaching and detaching operation of the developer casing 30. The gripper 35 is so configured as to protrude upwardly from the top wall 42 of the developer casing 30, for a general formation of a triangle when viewed laterally, and as to have serrations on the front face of the gripper 35 for facilitating the user to securely grip the developer casing 30.

A back wall 43 of the developer casing 30 is shaped generally flat in parallel to the flat-shaped front wall of a scanner casing 22 of the scanner unit 19.

A front wall 44 of the developer casing 30 is configured to include: the top end corner; the middle portion in the vertical direction; and the bottom end which is an agitator-facing wall 36 facing an agitator 48 disposed within the toner storage 31. The front wall 44 is formed, such that the top end corner is curved when viewed laterally, in continuous connection with the top wall 42, such that the middle portion is generally flat in parallel to the back wall 43, and such that the bottom end is curved when viewed laterally, along the locus of the tip end of the agitator 48 drawn during pivotal movement of the agitator 48.

Under the agitator-facing wall 36 in the front wall 44 of the developer casing 30, there is disposed a covering wall 37 that covers the supply roller 32 and the developer roller 33. The covering wall 37 is so configured as to integrally include; a top wall portion 38 over the supply roller 32; a slanting wall portion 39 over the supply roller 32; a covering wall portion 40 in front of the supply roller 32; and a covering wall portion 41 in front of the developer roller 33.

The top wall portion 38 is shaped, when viewed laterally, so as to be integrally joined with the rear end of the agitator-facing wall 36 that extends rearward along a curved line up to the rear end, and so as to extend, after being reversed at the rear end, forwardly in the horizontal line.

The slanting wall portion 39 is shaped, when viewed laterally, so as to extend integrally from the front end of the top wall portion 38 in an oblique direction extending both forwardly and downwardly.

The covering wall portion 40 is shaped, when viewed laterally, so as to extend integrally from the front end of the slanting wall portion 39 along a curved line surrounding the outer circumferential surface of the supply roller 32.

The covering wall portion 41 is shaped, when viewed laterally, so as to be integrally joined with the rear end of the covering wall portion 40 that extends rearward along a curved line up to the rear end, and so as to extend, after being reversed at the rear end, in an oblique direction extending both forwardly and downwardly.

With the bottom end of the back wall 43 of the developer casing 30, there is joined a blade-supporting wall 45 that extends in a forward direction slightly slanting upwardly. The free end of the blade-supporting wall 45 is disposed to face the back side portion of the developer roller 33.

At a portion of the back wall 43 of the developer casing 30 which is located over and near the bottom end of the back wall 43, there is provided a guide wall 46 that extends in a forward direction slightly slanting downwardly, so as to cover an upper portion of the blade-supporting wall 45.

Specifically, the guide wall 46 extends from the back wall 43, such that the front end of the guide wall 46 is disposed over the developer roller 33 and near a position at which the developer roller 33 and the thickness-regulating blade 34 are opposed to each other.

As a result, the guide wall 46 is disposed, so as to cover respective upper portions of the blade-supporting wall 45 and the thickness-regulating blade 34, and so as to be inclined with regard to the horizontal direction, such that the guide wall 46 is lowered at the front end thereof, which is near the developer roller 33, while the guide wall 46 is raised at the rear end thereof, which is far from the developer roller 33.

The guide wall 46, being a plate-shaped, is so disposed as to extend along the entire length of the developer casing 30 in a widthwise direction (referring to the axial direction of a supporting shaft 60 of the photoconductive drum 56 as described below, hereinafter the same).

The developer casing 30 is made up of material such as polystyrene resin, for example. The back wall 43 and the guide wall 46 of the developer casing 30 are integrally formed. Both side walls 51,51 are integrally formed with the top wall 42, the front wall 44 (including the agitator-facing wall 36 and the covering wall 37), the blade-supporting wall 45, and the guide wall 46, so as to extend toward the back wall 43 from the both lateral ends of each respective wall 42, 44, 45, and 46. The both side walls 51,51 are opposed to each other in the aforementioned widthwise direction. To the top-end portion of the back wall 43, the rear-end portion of the top wall 42 has been fused, while, to the both side portions of the back wall 43, the rear-end portions of the both side walls 51,51 have been fused respectively. Further, to the bottom-end portion of the back wall 43, the rear-end portion of the blade-supporting wall 45 has been fused. In the foregoing manner, the developer casing 30 has been formed.

An inner space of the developer casing 30 is partitioned into two spaces vertically apart from each other, namely, an upper-inner space and a lower-inner space. The upper-inner space is a space extending from the top wall 42 to the bottom-end portion of the agitator-facing wall 36 (namely, the rear-end portion of the agitator-facing wall 36 which continuously extends from the top wall portion 38 after being reversed), which constitutes the toner storage 31. On the other hand, the lower-inner space is a space extending from the top wall portion 38 to the bottom-end portion of the covering wall portion 41, which constitutes a developer chamber 47 that accommodates the supply roller 32, the developer roller 33, and the thickness-regulating blade 34.

Each toner storage 31 contains each corresponding toner functioning as a developer material for each corresponding single color. Each toner is a positively charged, non-magnetic mono-component, and polymeric toner for each color. The toner storage 31 of the yellow processing device 16Y contains a yellow toner, the toner storage 31 of the magenta processing device 16M contains a magenta toner, the toner storage 31 of the cyan processing device 16C contains a cyan toner, and the toner storage 31 of the black processing device 16K contains a black toner.

As a toner for each color, there is utilized a polymeric toner that has been prepared through a polymerization and that is approximately shaped in particle as a spherical. The polymeric toner is produced using as the principal component thereof binder resin prepared by copolymerizing, under a known polymerization such as the suspension polymerization, a styrene-based monomer such as styrene; and an acrylic-based monomer, such as acrylic acids, alkyl (between C1-C4) acrylate, and alkyl(between C1-C4) methacrylate. A colorant, a charge control agent, a wax, etc. are blended with the principal component to form a mother particle to which an external additive is further added. In the foregoing manner, the polymeric toner is produced.

As the aforementioned colorants, colorants for yellow, magenta, cyan, and black are applicable. As the aforementioned charge control agent, there is applicable a charge-control resin prepared through a copolymerization of both an ionic monomer having an ionic functional group, such as an ammonium salt; and a monomer, such as a styrene-based monomer, and an acrylic-based monomer, which is capable of being copolymerized with the ionic monomer. As the aforementioned external additive, there are applicable metal-oxide powder, such as silica, aluminum oxide, titanium oxide, strontium titanate, ceric oxide, and magnesium oxide; carbide powder; and inorganic powder such as metallic-salt powder, for example.

The agitator 48 for agitating toner is disposed at the bottom of the toner storage 31. The agitator 48 includes: a rotating shaft 49 that is rotatably supported at the both side walls 51,51 located at the respective sides spaced apart from each other in the aforementioned widthwise direction; and an agitating member 50 made up of a film extending radially from the rotating shaft 49.

In the agitator 48, transmission of a driving power of a motor (not shown) to the rotating shaft 49 would cause the rotating shaft 49 to be driven for rotation. Then, the agitating member 50 rotates in the direction indicated by the arrow (a clockwise direction). The action of the agitating member 50 moves a flow of toner stored in the toner storage 31 toward the developer chamber 47 from the rear-end portion of the agitator-facing wall 36.

The supply roller 32 is disposed in the top front area of the developer chamber 47. The supply roller 32 is so disposed under the top wall portion 38 as to extend along the curved area of the covering wall 40.

The supply roller 32 includes a metal roller shaft 32*a* covered with a rolling member made of an electro-conductive sponge member. The outer diameter of the supply roller 32 is smaller than that of the developer roller 33. The roller shaft 32*a* of the supply roller 32 is rotatably supported at the both side walls 51,51 of the developer casing 30. A driving power of a motor (not shown) is transmitted to the roller shaft 32*a*.

The supply roller 32 is disposed, in contact with the developer roller 33, so as to have an opposing relationship with the developer roller 33 at the nip zone. The supply roller 32 is driven for rotation in the direction indicated by the arrow (in a counterclockwise direction) so as to move in a direction opposite to the movement of the developer roller 33 at the nip zone.

The developer roller 33 is disposed in the bottom front area of the developer chamber 47. The developer roller 33 is compressed against the supply roller 32 in an opposing relationship therewith. The developer roller 33 faces the covering wall portion 41 in the front surface area of the developer roller 33, while faces the blade supporting wall 45 in the rear surface area of the developer roller 33. The developer roller 33 is disposed so as to be exposed at the bottom surface area thereof to the outside of the developer casing 30.

The developer roller 33 includes a metal roller shaft 33*a* covered with a rolling member made up of a resilient material such as an electro-conductive rubber material. The rolling member of the developer roller 33 is formed in a two-layer construction including; a rolling portion that is made up of a resilient material, such as an urethane rubber, a silicone rubber, and an EPDM rubber, all of which include carbon particles or the like and which are electrically conductive; and a coating layer that covers the surface of the rolling portion and that includes as the principal component of the coating layer, a material, such as an urethane rubber, urethane resin, and polyimide resin. The outer diameter of the developer roller 33 is smaller than that of the photoconductive drum 56. The roller shaft 33*a* of the developer roller 33 is rotatably supported at the both side walls 51,51 of the developer casing 30. A driving power of a motor (not shown) is transmitted to the roller shaft 33*a*.

The developer roller 33 is disposed in contact with the photoconductive drum 56, so as to have an opposing relationship with the photoconductive drum 56 at the nip zone. The developer roller 33 is driven for rotation in the direction indicated by the arrow (in a counterclockwise direction) so as to move in the same direction as the movement of the photoconductive drum 56 at the nip zone.

In development operation, a development bias is applied to the roller shaft 33*a* of the developer roller 33 from a power source (not shown). In the present embodiment, the development bias applied to the roller shaft 33*a* is set to a value within a range between approximately +430 volts and approximately +450 volts.

On the covering wall portion 41, there is disposed a film member 52 that is compressed against the front surface area of the developer roller 33. The film member 52 prevents leakage of toner through a clearance between the front surface area of the developer roller 33 and the covering wall portion 41.

The thickness-regulating blade 34 is provided over the entire length of the developer casing 30 in the aforementioned widthwise direction. The thickness-regulating blade 34 is disposed downstream from a position where the developer roller 33 and the supply roller 32 are opposed to each other, in the rotation direction of the developer roller 33. The thickness-regulating blade 34 includes a blade body 53 thereof made up of a metal plate-like spring member; and a pressing member 54 that is disposed at the free end portion of the blade body 53. The pressing member 54 is made up of an insulating silicone rubber, and has a cross section approximately shaped of semi-circle.

The fixed end portion of the blade body 53 is fused to the upper surface of the blade-supporting wall 45. The blade body 53 extends forwardly from the blade supporting wall 45, over a range from the fixed end portion to the free end portion. The free end portion of the blade body 53 is disposed to be opposed to the upper surface area of the developer roller 33.

On the upper surface of the free end portion of the blade body 53 (on the side of the guide wall 46), there is provided a sponge member (not shown) with which the free end portion of the guide wall 46 is placed in contact. As a result, waste toner which has been scraped away from the developer roller 33 by the rotation thereof is prevented from leaking into a space located over the thickness-regulating blade 34 through a clearance between the guide wall 46 and the thickness-regulating blade 34.

The pressing member 54 is disposed on the lower surface of the free end portion of the blade body 53. The pressing member 54 is compressed against the upper surface of the developer roller 33 under an elastic force of the blade body 53.

In the foregoing arrangement, the upper surface area of the developer roller 33 is in contact with the supply roller 32 at the front portion thereof, while is in contact with the pressing member 54 of the thickness-regulating blade 34 at the rear portion of the developer roller 33 which is spaced apart a predetermined distance from the nip zone of the supply roller 32.

The top wall portion 38, the supply roller 32, and the developer roller 33 are aligned to be lapped over one another in the vertical direction. When viewed from top to bottom in the vertical direction, the supply roller 32 is fully covered with the top wall portion 38, while the developer roller 33 is not covered over a region extending rearward from the rear end portion of the top wall portion 38, resulting in a partial exposure of the developer roller 33.

Once a toner which has been stored in the toner storage 31 has been agitated by the agitating member 50, there is introduced a flow of the toner toward the developer chamber 47 from the rear-end portion of the agitator-facing wall 36.

The moved toner is supplied to the developer roller 33 because of the rotation of the supply roller 32, and is then positively charged by friction between the supply roller 32 and the developer roller 33.

At this moment, the supply roller 32 and the developer roller 33 move in the respective opposite directions at the nip zone, with the result that the toner which has been supplied from the supply roller 32 to the developer roller 33 is efficiently charged, which contributes to a more preferred image development. Further, a residual toner remaining on the developer roller 33 without transferring onto the photoconductive drum 56 is capable of being scraped by means of the supply roller 32 in a more preferred manner.

The toner, which after being supplied to the developer roller 33, has been frictionally electrified thereat enters an area between the pressing member 54 of the thickness-regulating blade 34 and the developer roller 33, with the rotation of the developer roller 33. The entered toner is subsequently controlled to form a layer having a predetermined thickness by means of the thickness-regulating blade 34, and is carried, in the thickness regulated condition, on the developer roller 33.

Each of the photoconductive-drum units 21 is detachably attached to the body casing 2. Each photoconductive-drum unit 21 includes within each corresponding drum casing 55: the photoconductive drum 56 that is opposed to the developer roller 33; and a scorotron-type charger 57.

The drum casing 55 includes a drum containing portion 58 and a receiving portion 59 both of which are integrally formed. The drum containing portion 58 is formed approximately as a rectangular-solid frame being through-like which is open at the top and bottom ends thereof. The receiving portion 59, which extends upwardly from the drum containing portion 58, is formed so as to receive the covering wall 37 of the developer casing 30.

The photoconductive drum 56 is comprised of a cylindrical metallic-tube which is made up of a material such as aluminum, and is covered at the surface of the photoconductive drum 56 with a photoconductive layer comprised of an organic photoconductive material that includes polycarbonate as the principal component. The outer diameter of the photoconductive drum 56 is larger than that of the developer roller 33. The photoconductive drum 56 rotates about the supporting shaft 60. The supporting shaft 60 is rotatably supported at the both side walls of the drum containing portion 58. On one axial side of the supporting shaft 60, there is disposed a gear mechanism (not shown), via which a driving power of a motor (not shown) is transmitted to the supporting shaft 60. The photoconductive drum 56 rotates in the direction indicated by the arrow (a clockwise direction) so as to move in the same direction as the transport belt 67 at the nip zone where the photoconductive drum 56 and the transport belt 67 are opposed to each other in contact.

The scorotron-type charger 57 is fixed to the back wall of the drum containing portion 58. The fixed scorotron-type charger 57 is disposed at a position where is located rearward from the photoconductive drum 56 and which is spaced apart from the photoconductive drum 56 a predetermined distance enabling a non-contact relationship between the photoconductive drum 56 and the scorotron-type charger 57.

The scorotron-type charger 57 is of the scorotron type for positive charging, which introduces a corona discharge at a charging wire made up of a material such as tungsten. The scorotron-type charger 57 is provided for positively and uniformly charging the surface of the photoconductive drum 56 because of the application of a bias from a power source (not shown). In the present embodiment, the charged potential of the surface of the photoconductive drum 56 after being charged is set to approximately +900 volts.

The scanner unit 19 for each color is disposed spaced apart a predetermined distance from the transport belt 67 in the vertical direction. Each scanner unit 19 is fixed to the body casing 2. Each scanner unit 19 includes within each corresponding scanner casing 22: a laser emitting section (not shown); a polygon mirror 23; two lenses 24,25; and three reflecting mirrors 26,27,28.

The scanner casing 22 is shaped as an elongated box and is fixed to the body casing 2 so as to extend vertically. An exit window 29 through which a laser beam exits is provided at a portion of the wall of the scanner casing 21 which is opposed to the photoconductive-drum unit 21.

In the scanner unit 19, as shown by the dotted line in FIG. 2, a laser beam, which is based on an image data, is emitted from the laser emitting section (not shown), and is then reflected at the polygon mirror 23. The reflected laser beam is subsequently passed through the lens 24, the reflecting mirror 26, the reflecting mirror 27, the lens 25, and the reflecting mirror 28 in the description order, being subjected to a desired transmission or reflection, and then exits from the exit window 29.

The laser beam exiting from the exit window 29 is scanned on the photoconductive drum 56 in a higher speed, thereby to illuminate the photoconductive drum 56. The illumination causes the exposure of the surface of the photoconductive drum 56 that has been positively and uniformly charged by means of the scorotron-type charger 57. As a result, an electrostatic latent image based upon a predetermined image data is formed on the photoconductive drum 56. In the present embodiment, the potential of the surface of the photoconductive drum 56 after being exposed with the laser beam is set to approximately +200 volts.

As shown in FIG. 1, within the body casing 2, the transfer device 17 is disposed on one side of an array of the four photoconductive drums 56 parallelly juxtaposed in the horizontal direction, which is opposite to the four developer units 20 containing respective photoconductive drums 56, in opposing relationship with the four photoconductive drums 56. The transfer device 17 includes: a drive roller 65; a free roller 66; the transport belt 67; a transfer roller 68; and a belt cleaning device 71.

The free roller 66 is disposed forwardly from the photoconductive drum 56 of the yellow processing device 16Y. By contrast, the drive roller 65 is disposed rearward from the photoconductive drum 56 of the black processing device 16K.

The transport belt 67, in the form of an endless belt, is made up of conductive resin, such as polycarbonate and polyimide. Conductive particles such as carbon particles have been dispersed in the conductive resin. The transport belt 67 is wound around the drive roller 65 and the free roller 66. The transport belt 67 is disposed so as to contact at the outer contact surface thereof with all of the photoconductive drums 56 of the corresponding processing devices 16, in opposing relationship therewith.

The free roller 66 is driven by the drive roller 65, resulting in the transport belt 67 being circulated around the drive roller 65 and the free roller 66. The transport belt 67 is circulated in a counterclockwise direction so as to move at a contact surface where the transport belt 67 contacts the photoconductive drum 56 of each processing device 16 in the same direction as the photoconductive drum 56.

Each transfer roller 68 is disposed within the inside of the wound transport belt 67 so as to be opposed to the photoconductive drum 56 of the each corresponding processing device 16. As a result, the transport belt 67 is interposed between each transfer roller 68 and each photoconductive drum 56, both of which belong to the each corresponding processing device 16.

The transfer roller 68 includes a metal roller shaft covered with a rolling member made up of a resilient material such as an electro-conductive rubber material. The transfer roller 68 is capable of being rotated in a counterclockwise direction so as to move at the contact surface of the transfer roller 68 with which the transport belt 67 contacts in opposing relationship therewith, in the same direction as the circulation direction of the transport belt 67. During transfer, the transfer roller 68 receives a predetermined bias from a power source (not shown) in a direction allowing transfer of the toner image that has been carried on the photoconductive drum 56 to the sheet 3 of paper. The constant current control performed for the transfer roller 68 results in application of an appropriate transfer bias to a region between the transfer roller 68 and the photoconductive drum 56.

The belt cleaning device 71 is disposed downstream from the photoconductive drum 56 of the black processing device 16K.

The belt cleaning device 71 is provided to clean off a residual toner attached to the transport belt 67. To this end, the belt cleaning device 71 includes: a cleaning box 72; a primary cleaning roller 73; a secondary cleaning roller 74; and a cleaning blade 75.

The cleaning box 72 includes a storage portion for storing the waste toner removed from the transport belt 67. The primary cleaning roller 73 rotates in contact with the transport belt 67, and electrically collects the residual toner remaining on the transport belt 67 because of the application of a bias from a power source (not shown). The secondary cleaning roller 74 rotates in contact with the primary cleaning roller 73 and electrically collects the toner on the primary cleaning roller 73 because of the application of a secondary-cleaning bias from a power source (not shown). The cleaning blade 75 scrapes off and picks up the toner on the secondary cleaning roller 74, to thereby collect the residual toner on the secondary cleaning roller 74 for storage in the storage portion of the cleaning box 72.

The fusing device 18 is disposed rearward from the processing devices 16 and the transfer device 17, and is disposed at a downstream area of the travel path of a sheet 3 of paper. The fusing device 18 includes a heat roller 70 and a pressing roller 69. The heat roller 70 is comprised of a metallic tube upon which a release layer is formed. Along the axial direction of the metallic tube, a halogen lamp is provided within the inner space of the heat roller 70. The halogen lamp heats the surface of the heat roller 70 to a predetermined fusing temperature. The pressing roller 69 is provided for pressing the heat roller 70.

The exit section 6 includes: the paper exit 9; the exit tray 10; and the exit roller 11.

There will be described below a printing operation performed in the color laser printer 100 in order to print an image on a sheet 3 of paper.

When each surface area of the photoconductive drum 56 moves in a circumferential direction, upon rotation of the photoconductive drum 56 of each processing device 16, the surface of the photoconductive drum 56 is, first of all, positively and uniformly charged by means of the scorotron-type charger 57. Subsequently, during the rotation of the photoconductive drum 56, the laser beam exited from the scanner unit 19 is scanned on the surface of the photoconductive drum 56 in a higher speed, thereby to form an electrostatic latent image based upon an image data. The toner which has been carried on the developer roller 33 and which has been positively charged is then electrically moved into the portion of the photoconductive drum 56 on which an electrostatic latent image has been formed, which is to say, the portion of the surface of the photoconductive drum 56 which was uniformly and positively charged and which was reduced in the surface potential upon exposure thereof to the laser beam. The moved toner is carried on the photoconductive drum 56. As a result, the electrostatic latent image is visualized, to thereby achieve a reverse development. Due to this, a toner image for each color is formed on each respective photoconductive drum 56.

On the other hand, a sheet 3 of paper fed from the feeder section 4 is transported by means of the transport rollers 14,14 and is then transported because of the circulation motion of the transport belt 67 resulting from both the driving the drive roller 65 and the driven free roller 66. As a result, the sheet 3 of paper is sequentially brought into contact with each photoconductive drum 56 of each corresponding processing device 16. At this time, each toner image of each color which has been formed on the photoconductive drum 56 of each corresponding processing device 16 is sequentially and electrically transferred in superimposed registration onto the sheet 3 of paper which serves as an image transferred medium, thereby to form a toner image of multi-color on the sheet 3 of paper.

For instance, once a yellow toner-image formed on the photoconductive drum 56 of the yellow processing device 16Y is transferred onto a sheet 3 of paper, a magenta toner-image formed on the photoconductive drum 56 of the magenta processing device 16M is then transferred in superimposed registration to the sheet 3 of paper on which the yellow toner-image has been transferred. In a similar manner, a cyan toner-image formed in the cyan processing device 16C and a black toner-image formed in the black processing device 16K are successively superimposed in registration upon the previously-formed toner-image, whereby a multi-color image is formed on the sheet 3 of paper.

The color laser printer 100 is of a tandem type in which individual photoconductive drums 56 are mounted for respective single colors. Accordingly, the color laser printer 100 is capable of forming each single-color toner image at approximately the same speed as when a monochrome image is formed, resulting in a faster formation of a multi-color image.

The residual toner remaining on the photoconductive drum 56 without transferring onto the sheet 3 of paper (toner remaining even after transfer) is collected into the toner storage 31 of the developer unit 20 because of the rotation of the developer roller 33. That is to say, the residual toner remaining on the photoconductive drum 56 is charged by means of the scorotron-type charger 57, and is then exposed with laser light emitted from the scanner unit 19, with the result that an electrostatic latent image is formed. On the other hand, toner remaining on the non-exposed area of the surface of the photoconductive drum 56 where has not been exposed is electrically moved toward the developer roller 33 and is then scraped by means of the supply roller 32 for collection into the toner storage 31.

As described above, the color laser printer 100 is of the type which is referred to in the art as "cleanerless type."

On the exposed area of the surface of the photoconductive drum 56, there reside both the remaining toner on the photoconductive drum 56 and the toner moved from the developer roller 33 to the photoconductive drum 56, and these toners are transferred from the photoconductive drum 56 onto a sheet 3 of paper at the transfer station.

The remaining toner attached to the transport belt 67 is removed by means of the belt cleaning device 71.

The multi-color toner image which has been transferred onto a sheet 3 of paper is heat-fused to the sheet 3 in the fusing device 18 when the sheet 3 is passing between the heat roller 70 and the pressing roller 69.

The sheet 3 of paper on which an image has been printed in the aforementioned manner exits from the body casing 2 at the paper exit 9 by means of the exit roller 11, and is then stacked on the exit tray 10.

In the color laser printer 100, the transfer bias applied to each transfer roller 68 is set to a value suitable to suppress a reverse-transfer of a toner from a sheet 3 of paper to the photoconductive drum 56. Specifically, the transfer bias applied to each transfer roller 68 is set to a value for allowing the surface potential of a part of four single-color separated-toner images to be finally transferred onto the sheet 3 which has been previously transferred to the sheet 3, to fall within the range for enabling the suppression of a reverse-transfer of the toner on the sheet 3 to the photoconductive drum 56.

The inventors of the present invention verified that there exists the relationship indicated by the graphs shown in FIG. 3 between the surface potential of a toner image and the amount of toner undergoing the reverse transfer, through the experiment, the content of which will be described below.

The experimental conditions are as follows:

Printer utilized for conducting the measurement:

A monochrome-type laser printer was utilized which was obtained by modifying a conventional monochrome-type laser printer, so that a toner image which had been transferred to a sheet of paper can be ejected without fusing process, and so that, when the same sheet is again passed through the monochrome-type laser printer, the same sheet can be subjected to a superimposed registration of toner images.

Subject to be measured:

The toner image was transferred sequentially to the same sheet at a first and a second passing of the same sheet of paper so as to print the same pattern described below. At a first and a second passing of a sheet of paper through the above printer, two respective toner images having the same pattern described below were transferred sequentially to the sheet to perform a two-layer superimposed registration. At a third passing of the sheet through the printer, the sheet was printed in white by the printer, and there was conducted the above measurement as described below in more detail.

Print pattern:

solid region being 50 mm in length and 20 mm in width

Print speed:

150 mm/second

Surface potential of photoconductor:

+900 volts for non-exposed area

+200 volts for exposed area

Development bias:

+435 volts for toner No. 1

+450 volts for toner No. 2

Transfer current:

−10 to −30 μA

Amount of toner attached:

0.6 mg/cm$^2$

Figure 4:
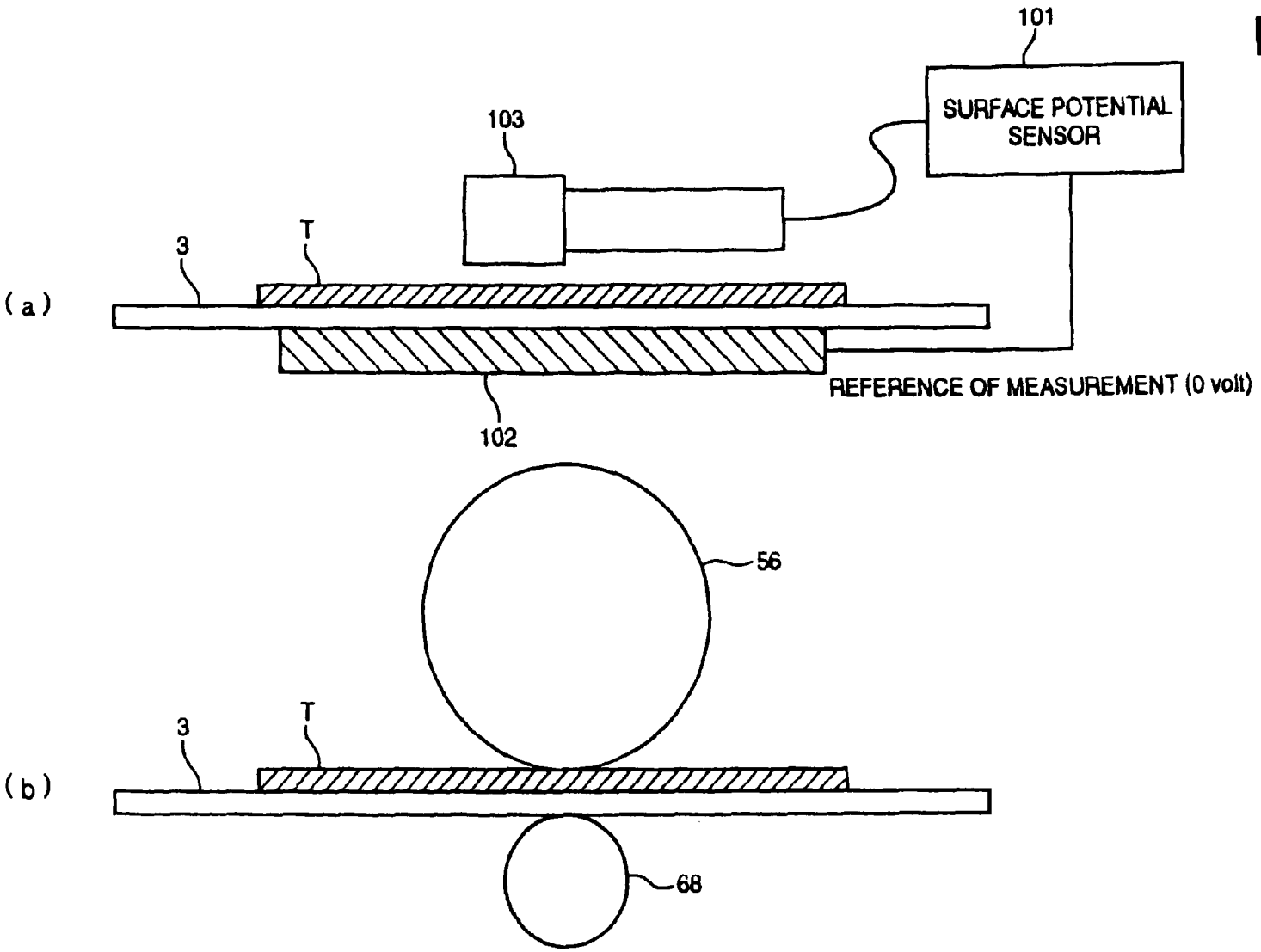
FIG. 4 is side views for illustrating how the experiment mentioned above was conducted.

During the measurement, first of all, as shown in FIG. 4(*a*), there was measured using a surface potential sensor 101 the surface potential of the toner image T (specifically, a toner image having a two-layer structure), which had been transferred to the sheet 3 of paper. Particularly, the sheet 3 of paper is put on an electro-conductive plate 102 electrically coupled with the surface potential sensor 101, and then the surface potential of the toner-image T on the sheet 3 of paper was measured using a measuring probe 103 of the surface potential sensor 101, with the measurement reference potential being set to 0 volt.

Then, as shown in FIG. 4(*b*), the sheet 3 of paper to which the toner image T had been transferred was so transported as to pass between the photoconductive drums 56 (in a non-exposed state) in a circumferential motion, and the transfer rollers 68, in the same manner as a printing operation ordinary performed in a color laser printer. Then, the sheet 3 was stopped in contact with the photoconductive drum 56 (depicted in FIG. 4(*b*)), and the amount of a toner which had been reversely transferred from the sheet 3 onto the photoconductive drum 56 was measured.

To be more specific, the toner reversely-transferred to the photoconductive drum 56 was collected by the use of a transparent self-adhesive tape, and the index of reflection of the transparent self-adhesive tape adhering the toner was then measured. The percentage of reduction in amount of reflected light was calculated respectively for each sample value of the transfer bias, and the calculation results were utilized for the indices enabling a relative comparison of the amount of the toner reversely-transferred at each value of the transfer bias with that at another value of the transfer bias. Described for illustrative purposes, in the case where the index of reflection of the self-adhesive tape to which no toner has been attached is 85% and where the measured index of reflection is 75%, the amount of toner reversely-transferred is calculated using the formula of "85%-75%=10%."

Figure 3:
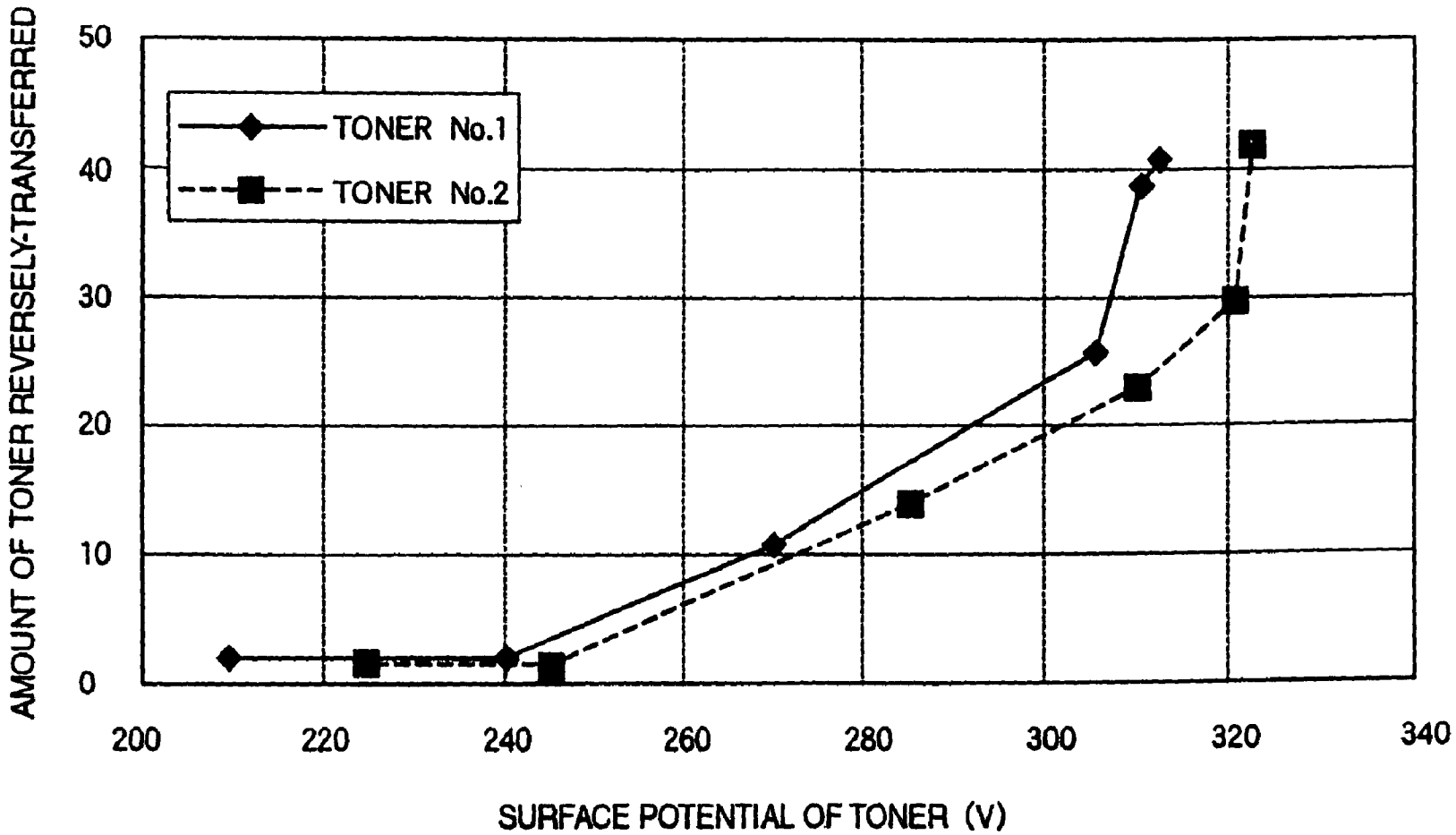
FIG. 3 is a graph representing a relationship, verified through an experiment conducted by the inventors using an experimental laser printer, between a surface potential of a toner image and the amount of toner which is reversely transferred from an image transferred medium to a photoconductor.

The above measurement was conducted respectively for two kinds of toners (i.e., toner No. 1 and toner No. 2) in the aforementioned manner, revealing the above relationship indicated by the graphs shown in FIG. 3.

As is understood from the graphs shown in FIG. 3, when the surface potential of toner image exceeds 300 volts, the amount of the toner reversely-transferred is rapidly increased. On the other hand, when the surface potential of toner image does not exceed 250 volts, the amount of the toner reversely-transferred is limited to an extremely small value. Therefore, it is preferable to control the surface potential of toner image to be less than or equal to 300 volts, and it is more preferable to control the surface potential of toner image to be less than or equal to 250 volts.

Thus, a fixed relationship is established between the surface potential of the toner image and the amount of toner reversely-transferred. The mechanism which induces the relationship will be discussed below.

The surface potential of a toner image exceeding 300 volts would make it easy for an electrical discharge between the surface layer of the toner image and the surface of the sheet 3 of paper to occur. Due to zero potential on the surface of the sheet 3, the surface potential of the toner image exceeding 300 volts is equivalent to a potential difference exceeding 300 volts between the surface of the sheet 3 and the surface layer of the toner image.

An electrical discharge between the surface layer of a toner image and the surface of a sheet 3 of paper causes a dissipation of positive charges previously stored within a toner, resulting in a decrease in charge amount of the toner image. The decrease in charge amount of the toner image induces a phenomena in which a toner is reversed from the sheet 3 to the photoconductive drum 56, which is called "reverse transfer."

The surface layer of a toner image consists of a collection of particles, and therefore, the surface potentials of the toner image, as individually observed, are not distributed uniformly over the entire surface, exhibiting nonuniformity to a degree.

In order that the surface layer of the toner image, despite the above nonuniformity, can be nearly free from a portion having a surface potential exceeding 300 volts, it is more preferable that the surface potential of the toner image is controlled, such that a measurement of the surface potential of the toner image, i.e., the surface potential of a representative portion of the toner image does not exceed a selected level lower than 300 volts by a margin set in expectation of the above nonuniformity. The selected level may be 250 volts, for example.

In view of the above findings, in the color laser printer 100, the transfer bias applied to each transfer roller 68 is set so that the surface potential of toner image formed on a sheet 3 of paper before contacting the photoconductive drum 56 of the black processing device 16K can become less than or equal to 250 volts. The toner image on the sheet 3 before contacting the photoconductive drum 56 of the black processing device 16K has been selected as the toner image which is to be controlled such that the surface potential of the toner image is less than or equal to 250 volts for the following reasons:

A case exists where a subset of the four single-color separated-toner-images which are to be eventually transferred to a sheet 3 of paper has been transferred to the sheet 3. In this case, the charge amount and the surface potential of the toner image on the sheet 3 is maximized at a time after the sheet 3 is passed through the photoconductive drum 56 of the cyan processing device 16C and before the sheet 3 is brought into contact with the photoconductive drum 56 of the black processing device 16K.

The charge amount of a toner image on a sheet 3 of paper is increased after the sheet 3 has been passed through the photoconductive drum 56 of the black processing device 16K. The present toner image, however, will not be thereafter brought into contact with any other photoconductive drum.

Therefore, even if the surface potential of the toner image exceeds 250 volts due to the sheet 3 passing through the photoconductive drum 56 of the black processing device 16K, a problem of a reverse transfer of the toner image will not be caused within an area downstream from the black processing device 16K.

In the present embodiment, there is set the transfer bias applied to each of ones of the four transfer rollers 68 which precede the transfer roller 68 opposed to the photoconductive drum 56 of the black processing device 16K, so that the surface potential of a toner image on a sheet 3 of paper becomes less than or equal to 250 volts before the sheet 3 is brought into contact with the photoconductive drum 56 of the black processing device 16K. It follows that the surface potential of each of preceding ones of the four photoconductive drums 56 which respectively correspond to the above preceding transfer rollers 68, can be limited so as not to exceed 250 volts, as well.

A tendency exists that the higher the transfer bias (i.e., the larger a transfer power of an toner image to be transferred), the larger the charge amount of the toner image (i.e., the higher the surface potential of the toner image). In view of the tendency, the transfer bias is, and the transfer power is resultantly, set to a reduced value large sufficient not to adversely affect the performance of the transfer of a toner image from the photoconductive drum 56 to the sheet 3 of paper.

In the present embodiment, there is appropriately set the transfer bias applied to each of ones of the four transfer rollers 68 which are opposed respectively to ones of the four photoconductive drums 56 upstream of the photoconductive drum 56 of the black processing device 16K, so that the surface potential of a toner image on a sheet 3 of paper becomes less than or equal to 250 volts before the sheet 3 is brought into contact with the photoconductive drum 56 of the black processing device 16K.

On the other hand, the surface potential of a toner image on a sheet 3 of paper is raised upon transfer at the black processing device 16K, as with the remainder of the four processing devices 16Y, 16M, 16C, 16K which precedes the black processing device 16K. For the reason, the surface potential of the toner image, even if it is not above 250 volts prior to transfer, may possibly exceed 250 volts upon transfer, at the black processing device 16K. The event may possibly cause the reverse transfer at the black processing device 16K.

In view of the above, the present invention is preferably practiced in a mode that there is appropriately set the transfer bias applied to each of three transfer rollers 68 which are opposed to respective three photoconductive drums 56 belonging to three processing devices 16Y, 16M, 16C, or to all the four transfer rollers 68, so that the surface potential of a toner image on a sheet 3 of paper becomes less than or equal to 250 volts, not only immediately before the sheet 3 is brought into contact with the photoconductive drum 56 of the black processing device 16K (i.e., immediately before transfer at the black processing device 16K), but also immediately after the sheet 3 is brought into contact with the photoconductive drum 56 of the black processing device 16K (i.e., immediately after transfer at the black processing device 16K).

In the color laser printer 100 according to the present embodiment, the scanner unit 19 constructs an example of the aforementioned latent-image forming device, the developer unit 20 constitutes an example of the aforementioned developer unit, and the photoconductive drum 56 constitutes an example of the aforementioned photoconductor.

As may be readily understood from the foregoing, the color laser printer 100 according to the present embodiment would provide the following advantages:

1. Prevention of Deterioration in Image Quality

During a process in which single-color toner images are successively transferred to a sheet 3 of paper in superimposed registration, the surface potential of a previously-transferred single-color toner image to the sheet 3 is regulated to fall within a range enabling the suppression of a reverse transfer of the toner, at a time when an additional single-toner toner-image attempts to be subsequently transferred onto the same sheet 3.

The color laser printer 100 would therefore allow the suppression of a reverse transfer of a toner from a sheet 3 of paper to the photoconductive drum 56, resulting in the prevention of the deterioration in quality of a toner image on the sheet 3.

2. Suppression of Unintended Mix of Toner Colors

In the case of a cleanerless-type laser printer such as the color laser printer 100, if a toner is reversely transferred from a sheet 3 of paper to the photoconductive drum 56, there is collected or accumulated in the toner storage 31 within the developer unit 20 a toner different in color from a toner originally stored in the same toner storage 31, eventually causing a problem of the mix of toner colors in the same toner storage 31.

However, the color laser printer 100, since it prevents a reverse transfer of a toner, would suppress the mix of toner colors.

3. Control of Surface Potential of Toner Image without Requiring Additional Configuration The color laser printer 100 is constructed such that the surface potential of a toner image on a sheet 3 of paper is regulated because of an appropriately set value of the transfer bias. The color laser printer 100 would therefore enable the surface potential of a toner image on the sheet 3 to fall within a predetermined range, without requiring an incorporation of an additional element into a conventional color laser printer.

Further to the foregoing, in the color laser printer 100 according to the present embodiment, the transfer bias applied to each transfer roller 68 is set to a value enabling the surface potential of a part, not the whole, of four single-color toner images to be finally transferred to a sheet 3 of paper which has been previously transferred to the sheet 3, to fall within a range sufficient to suppress the reverse transfer of the toner image on the sheet 3 to the photoconductive drum 56. However, the present invention may be practice in alternative modes.

According to one of the alternative modes of the present invention, the surface potential of each photoconductive drum 56 (specifically, the surface potential thereof found after being charged by means of each corresponding scorotron-type charger 57), instead of the transfer bias applied to each transfer roller 68, is set to a value enabling the surface potential of a toner image on the sheet 3 to fall within a range allowing the suppression of a reverse transfer of a toner from the sheet 3 to the photoconductive drum 56.

In the above mode, the surface potential of a toner image on a sheet 3 of paper is regulated because of an appropriately set value of the surface potential of each photoconductive drum 56. In the mode, the charge amount of the photoconductive drum 56 is made smaller (i.e., its surface potential is made lower), leading to a reduced charge amount of the toner image on the sheet 3 of paper (i.e., a reduced surface potential of the toner image).

When the above mode is selected and practiced, the surface potential of a toner image on a sheet 3 of paper can be caused to fall within a predetermined range, without requiring an incorporation of an additional element into a conventional color laser printer, similarly with the color laser printer 100 according to the above-described first embodiment of the present invention.

According to another mode of the present invention, the amount of toner attached to a sheet 3 of paper for forming a reference image, instead of the transfer bias applied to each transfer roller 68, is set to a value enabling the surface potential of a toner image on the sheet 3 of paper to fall within a range allowing the suppression of a reverse transfer of a toner from the sheet 3 to the photoconductive drum 56.

The amount of toner attached to a sheet 3 of paper described above means a mass of toner used for forming an image, which may be expressed as a mass of toner required per unit area in the image to be formed.

In the above mode, the amount of toner required to form the reference image (a certain fixed image) is regulated, to thereby optimize the surface potential of a toner image on a sheet 3 of paper. Described more specifically, in the mode, the amount of toner attached to the sheet 3 of paper is made smaller (i.e., the surface potential of the toner is made lower), leading to a reduced charge amount of the toner image on the sheet 3 of paper (i.e., a reduced surface potential of the toner image). The amount of toner attached may be regulated depending upon the kind of a toner employed, for example.

When the mode is selected and practiced, the surface potential of a toner image on a sheet 3 of paper can be caused to fall within a predetermined range, without requiring an incorporation of an additional element into a conventional color laser printer, similarly with the color laser printer 100 according to the above-described first embodiment.

There will be described a color laser printer according to a second embodiment of the present invention.

Figure 5:
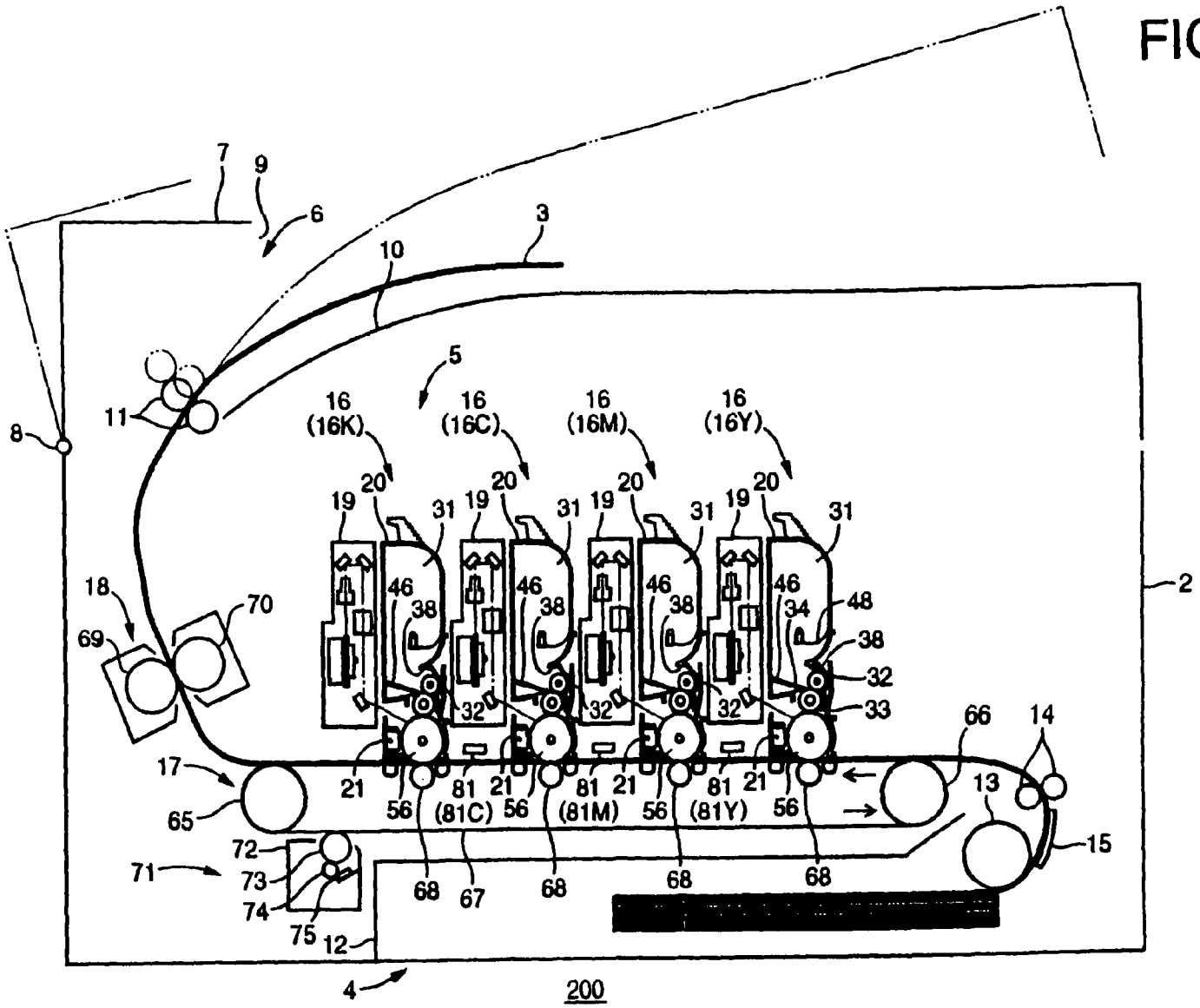
FIG. 5 is a cross-sectional side view illustrating a relevant portion of a color laser printer according to a second embodiment of the present invention.

FIG. 5 shows a relevant portion of a color laser printer 200 according to the present embodiment in a side cross-sectional view. As shown in FIG. 5, the color laser printer 200, as compared with the color laser printer 100 according to the aforementioned first embodiment (shown in FIG. 1), differs in that the color laser printer 200 includes the construction for detecting the surface potential of the toner image which has been transferred onto a sheet 3 of paper (such as a measuring probe 81 as described below).

Then, there will be described in more detail of the color laser printer 200 including the elements common to those of the color laser printer 100 shown in FIG. 1, which elements will be referenced in FIG. 5 the same reference numerals as those in FIG. 1 instead of describing these elements in more detail.

As shown in FIG. 5, the color laser printer 200 according to the present embodiment includes three measuring probes 81Y, 81M, and 81C all of which are provided for detecting the surface potential of the toner image that has been transferred onto a sheet 3 of paper. Each measuring probe 81 is disposed so as to be spaced apart a predetermined distance from the transport belt 67 in the vertical direction in non-contact relationship with the toner image on the sheet 3 transported via the transport belt 67.

Specifically, the measuring probe 81Y is disposed between the yellow processing device 16Y and the magenta processing device 18Y, and is utilized for detecting the surface potential of the toner image on the sheet 3 after the yellow toner-image has been transferred to the sheet 3 by means of the photoconductive drum 56 of the yellow processing device 16Y.

The measuring probe 81M is disposed between the magenta processing device 16M and the cyan processing device 16C, and is utilized for detecting the surface potential of the toner image on the sheet 3 after the magenta toner-image has been transferred to the sheet 3 by means of the photoconductive drum 56 of the magenta processing device 16M.

The measuring probe 81C is disposed between the cyan processing device 16C and the black processing device 16K, and is utilized for detecting the surface potential of the toner image on the sheet 3 after the cyan toner-image has been transferred to the sheet 3 by means of the photoconductive drum 56 of the cyan processing device 16C.

That is to say, the color laser printer 200 is configured, such that the measuring probes 81 detect the surface potential of a part of four single-color separated toner images to be finally transferred onto the sheet 3 which has been previously transferred to the sheet 3, wherein the surface potential means the surface potential of the toner image on the sheet 3 before contacting one of the photoconductive drum 56 which is subsequently operated.

Then, there will be described the electrical configuration of the color laser printer 200.

Figure 6:
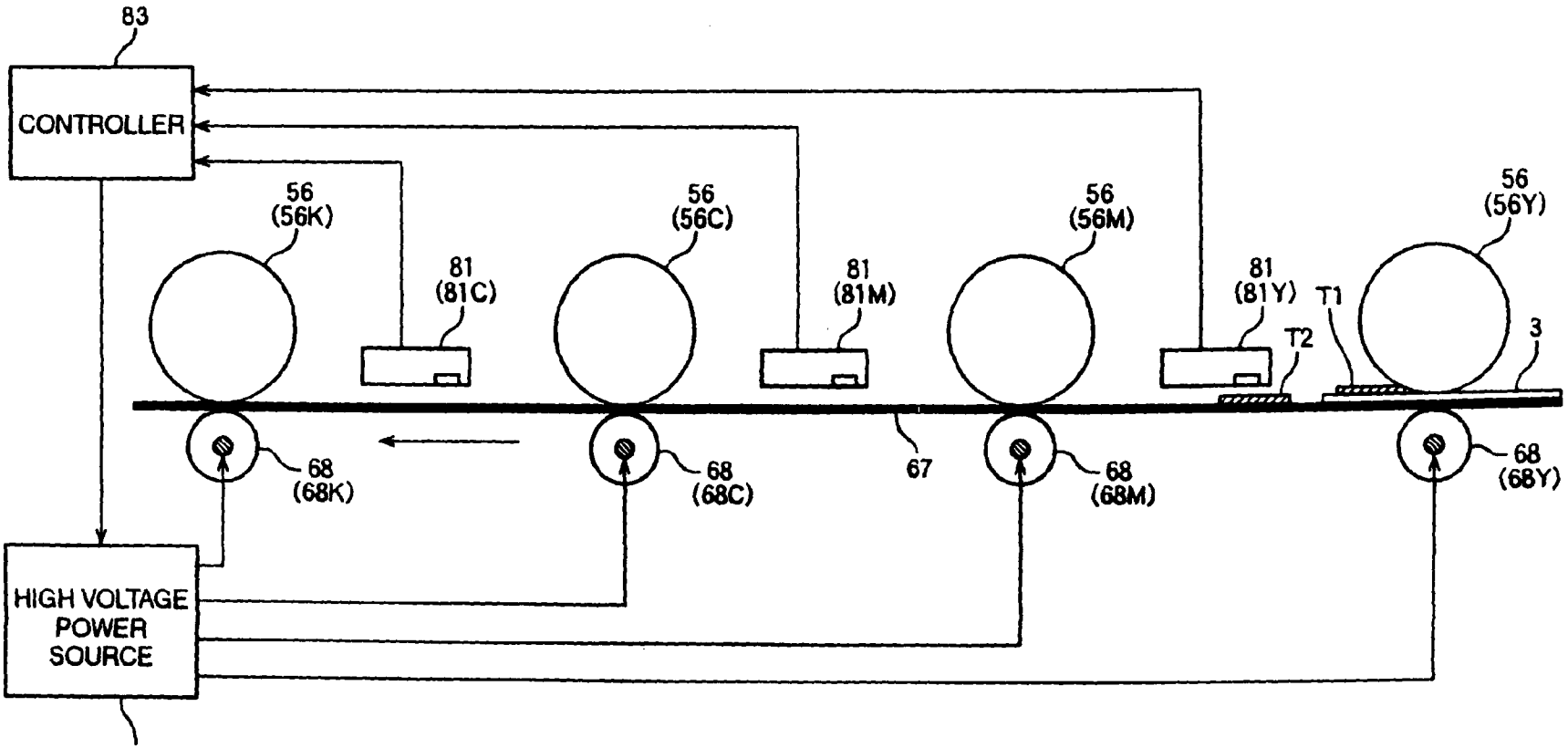
FIG. 6 is a side view illustrating the electrical construction of the color laser printer shown in FIG. 5.

As shown in FIG. 6, the color laser printer 200 includes a high voltage power source 82 for applying a transfer bias to each transfer roller 68; and a controller 83 for controlling the transfer bias applied to each transfer roller 68 using the high voltage power source 82 based upon the detected surface potential of each toner image on the sheet 3 of paper.

In the color laser printer 200, a surface potential control is performed in such a manner that the transfer bias applied to each transfer roller 68 is controlled based upon the surface potential of a toner image T1 which has been transferred to the sheet 3, to thereby prevent the reverse transfer of the toner image T1 from the sheet 3 onto the photoconductive drum 56. The surface potential control constitutes an example of the aforementioned anti reverse-transfer control.

The toner image T1 transferred onto the sheet 3 of paper is varied in size, shape, etc., depending on a composite image to be printed on the sheet 3, with the result that there may exist difficulties, due to the content of the image to be reproduced, in detecting the surface potential of the toner image T1 by means of the measuring probes 81.

Then, the color laser printer 200 is constructed such that, when a composite image attempts to be printed on a sheet 3 of paper, separated toner images T2 standardized for detecting the surface potential using the measuring probes 81 (hereinafter, referred to as "detection-standardized toner images") are directly transferred onto the transport belt 67, as opposed to the separated images T1 corresponding to a resulting composite image to be printed on the sheet 3. More specifically, the detection-standardized toner images T2 provided for the respective yellow, magenta, and cyan colors are sequentially transferred onto the transport belt 67 in superimposed registration at a selected position located forwardly from the sheet 3 on the transport belt 67. The selected position is a position on the transport belt 67 at which the transport belt 67 is brought into contact with the photoconductive drum 56 earlier than the sheet 3 during advance of the transport belt 67.

The detection-standardized toner images T2 are enough if they are each formed as a result of transfer to the transport belt 67 of a toner, the amount of which is sufficient to detect the surface potential of the toner image T2 using each corresponding measuring probe 81, and therefore the detection-standardized toner images T2 may be each shaped as a figure, such as a rectangle, a circle, etc. The detection-standardized toner images T2 are removed, after detection of the surface potential, from the transport belt 67 using the belt cleaning device 71.

In the color laser printer 200, the surface potential of each detection-standardized toner image T2 transferred onto the transport belt 67, instead of the surface potential of each toner image T1 transferred onto a sheet 3 of paper, is detected respectively, and then the aforementioned surface potential control is performed based on the detected value of the surface potential of each detection-standardized toner image T2 respectively.

Then, there will be described with reference to the flow chart shown in FIG. 7 a surface potential control program executed by means of a computer within the controller 83 for achieving the above surface potential control. The surface potential control program is executed once each time the printing operation is performed per page of a sheet 3 of paper, and the surface potential control is performed during each printing operation, i.e., during each operation for forming each corresponding one image.

The surface potential control program is initiated with a step S100 to apply a transfer bias having a predetermined fixed magnitude to the transfer roller 68Y to which the photoconductive drum 56Y of the yellow processing device 16Y is opposed.

The step S100 is followed by a step S110 to detect the surface potential of the detection-standardized toner image T2 via the measuring probe 81Y. That is to say, there is detected the detection-standardized toner image T2 of the yellow color which has been transferred to the sheet 3 by means of the photoconductive drum 56Y of the yellow processing device 16Y.

A determination may be made as to whether or not the detected value by the measuring probe 81Y represents the surface potential of the detection-standardized toner image T2, by referring to the known relationship between a lapse of time and the successive positions of the sheet 3 during transport thereof.

The step S110 is followed by a step S120 to determine the transfer bias to be applied to the transfer roller 68Y opposed to the photoconductive drum 56 of the yellow processing device 16Y, based on the surface potential of the detection-standardized toner image T2 detected in the step S110.

Described more specifically, the controller 83 has stored therein data indicative of a table representing the correspondence between values of the surface potential to be detected using the measuring probe 81, and respective designated values of the transfer bias to be applied to the transfer roller 68 for transferring a toner image to the sheet 3. According to the stored table, the controller 83 determines the current value of the transfer bias.

The stored table includes a sub-table representing the correspondence between values of the surface potential to be detected using the measuring probe 81Y, and respective designated values of the transfer bias to be applied to the transfer roller 68Y. The stored table further includes a sub-table representing the correspondence between values of the surface potential to be detected using the measuring probe 81M, and respective designated values of the transfer bias to be applied to the transfer roller 68M. The stored table still further includes a sub-table representing the correspondence between values of the surface potential to be detected using the measuring probe 81C, and respective designated values of the transfer bias to be applied to the transfer roller 68C.

In the color laser printer 200, the correspondence between the surface potential and the transfer bias is preset, so that the surface potential of a toner image on a sheet 3 of paper found before the sheet 3 is brought into contact with the photoconductive drum 56K of the black processing device 16K becomes not exceeding 250 volts, as a result of the determination and application of the actual value of the transfer bias according to the above table representing the above correspondence.

Therefore, in the color laser printer 200, the surface potential control is performed so that the surface potential of a toner image on a sheet 3 of paper may not exceed 250 volts. The reason is that, as described in the first embodiment of the present invention with reference to the graphs shown in FIG. 3, if the surface potential of a toner image exceeds 300 volts, the amount of a toner reversely-transferred is rapidly increased, while if the surface potential of a toner image on the sheet 3 does not exceed 250 volts, it is possible to restrict the amount of a toner reversely-transferred to an extremely small value.

Further to the above, in an alternative embodiment of the present invention, the correspondence between the surface potential and the transfer bias may be preset, so that the surface potential of a toner image on a sheet 3 of paper found before the sheet 3 is brought into contact with the photoconductive drum 56K of the black processing device 16K becomes not exceeding 300 volts, for example, as a result of the determination and application of the actual value of the transfer bias according to the above table representing the above correspondence.

The step S120 is followed by a step S130 to apply a transfer bias having a predetermined fixed magnitude to the transfer roller 68M.

The step S130 is followed by a step S140 to detect the surface potential of the detection-standardized toner image T2 using the measuring probe 81M. That is to say, there is detected the detection-standardized toner image T2 of the magenta color which has been transferred to the sheet 3 by means of the photoconductive drum 56M of the magenta processing device 16M.

Similarly with the aforementioned measuring probe 81Y, a determination may be made as to whether or not the detected value using the measuring probe 81M represents the surface potential of the detection-standardized toner image T2, by referring to the known relationship between a lapse of time and the successive positions of the sheet 3 during transport thereof.

The step S140 is followed by a step S150 to determine the transfer bias to be applied to the transfer roller 68M opposed to the photoconductive drum 56 of the magenta processing device 16M, based on the surface potential of the detection-standardized toner image T2 detected in the step S140.

The step S150 is followed by a step S160 to apply a transfer bias having a predetermined fixed magnitude to the transfer roller 68C.

The step S160 is followed by a step S170 to detect the surface potential of the detection-standardized toner image T2 using the measuring probe 81C. That is to say, there is detected the detection-standardized toner image T2 of the cyan color which has been transferred to the sheet 3 by means of the photoconductive drum 56C of the cyan processing device 16C.

Similarly with the aforementioned measuring probes 81Y, 81M, a determination may be made as to whether or not the detected value by the measuring probe 81C represents the surface potential of the detection-standardized toner image T2, by referring to the known relationship between a lapse of time and the successive positions of the sheet 3 during transport thereof.

The step S170 is followed by a step S180 to determine the transfer bias to be applied to the transfer roller 68C opposed to the photoconductive drum 56 of the cyan processing device 16C, based on the surface potential of the detection-standardized toner image T2 detected in the step S170.

Then, one cycle of execution of the surface potential control program is terminated.

As a result of the execution of the surface potential control program, namely, the implementation of the surface potential control, the appropriate values of the transfer biases which have been determined in the respective steps S120, S150, and S180 are applied to the respective transfer rollers 68Y, 68M, and 68C, during the respective processes to actually transfer the respective single-color toner-images to a sheet 3 of paper, so as to follow the detection of the surface potential of the standardized toner image T2. Because of the surface potential control, the image forming operation is better performed while preventing the surface potential of a toner image from exceeding 250 volts.

As may be easily understood from the foregoing, in the color laser printer 200, the scanner unit 19 constitutes an example of the aforementioned latent-image forming device, the developer unit 20 constitutes an example of the aforementioned developer unit, the photoconductive drum 56 constitutes an example of the aforementioned photoconductor, the measuring probe 81 constitutes an example of the aforementioned surface potential sensor, and the controller 83 constitutes an example of the aforementioned controller.

As is evident from the above description, the color laser printer 200 according to the present embodiment would offer basically the same advantages as the first and second advantages, as described above, offered by the color laser printer 100 according to the above-described first embodiment of the present invention. As described above in more detail, the first advantage is the prevention of deterioration in image quality, and the second advantage is the suppression of unintended mix of toner colors.

In addition to the above advantages, the color laser printer 200, since it is made so as to regulate the surface potential of a toner image on a sheet 3 of paper because of the adjustment of the actual value of the transfer bias, would achieve the prevention of a reverse transfer of a toner from the sheet 3 to the photoconductive drum 56, without requiring an incorporation of an additional arrangement for use in varying the actual value of the surface potential of the toner image on the sheet 3.

Further to the above advantages, the color laser printer 200, since it is made so as to detect the surface potential of a toner image using the measuring probe 81, would stably suppress a reverse transfer of a toner from a sheet 3 of paper to the photoconductive drum 56, irrespective of variations in environmental conditions such as temperature and humidity; deterioration with age in property of the color laser printer 200; and the like.

Still further, the color laser printer 200, since it is made so as to perform the surface potential control based on the surface potential of the detection-standardized toner image T2, would stably perform the surface potential control, irrespective of variations of the content of the toner image T1 to be transferred to a sheet 3 of paper for representation.

Additionally, the color laser printer 200, since it is made so as to perform the surface potential control respectively on a page-by-page printing-process basis, would suitably suppress a reverse transfer, irrespective of variations in the above environmental conditions, etc., on a page-by-page printing-process basis.

In the present embodiment, there is controlled the transfer bias applied to each of three transfer rollers 68 which are opposed respectively to three photoconductive drums 56 upstream of the photoconductive drum 56 of the black processing device 16K, so that the surface potential of a toner image on a sheet 3 of paper becomes less than or equal to 250 volts before the sheet 3 is brought into contact with the photoconductive drum 56 of the black processing device 16K.

Alternatively, in order to eliminate the possibility that the reverse transfer of the toner occurs during transfer at the black processing device 16K, the present invention is preferably practiced in a mode that there is controlled the transfer bias applied to each of three transfer rollers 68 which are opposed to respective three photoconductive drums 56 belonging to three processing devices 16Y, 16M, 16C, or to all the four transfer rollers 68, so that the surface potential of a toner image on a sheet 3 of paper becomes less than or equal to 250 volts, not only immediately before the sheet 3 is brought into contact with the photoconductive drum 56 of the black processing device 16K (i.e., immediately before transfer at the black processing device 16K), but also immediately after the sheet 3 is brought into contact with the photoconductive drum 56 of the black processing device 16K (i.e., immediately after transfer at the black processing device 16K).

As described above, the color laser printer 200 according to the present embodiment is constructed so as to perform the surface potential control for suppressing a reverse transfer of a toner image, after once the toner image has been transferred to a sheet 3 of paper, from the sheet 3 to the photoconductive drum 56, in such a manner that the surface potential of the detection-standardized toner image T2 transferred to the transport belt 67 is detected, and, based on the detected value, the transfer bias applied to each transfer roller 68 is controlled. The present invention, however, may be practiced in alternative modes.

According to one of the above alternative modes, the surface potential control is performed, such that there is controlled the surface potential of each photoconductive drum 56 (more specifically, the surface potential of each photoconductive drum 56 after charged by each corresponding scorotron-type charger 57), instead of the transfer bias applied to each transfer roller 68.

In the above mode, the surface potential of each photoconductive drum 56 is adjusted based on the surface potential detected using each corresponding measuring probe 81. Even this mode, once practiced, would allow the prevention of the reverse transfer of a toner from a sheet 3 of paper to the photoconductive drum 56 without requiring an incorporation of an additional construction for varying the surface potential of a toner image on the sheet 3, similarly with the above-described second embodiment of the present invention.

As described above, the color laser printer 200 according to the second embodiment of the present invention is made so as to detect the surface potential of the detection-standardized toner image T2 which has been transferred to the transport belt 67. The present invention, however, may be practiced in alternative modes.

According to one of the above alternative mode, the surface potential of the regular toner image T1 which has been transferred to a sheet 3 of paper is directly detected. This mode would be more advantageous in reducing the amount of waste toner required to be removed from the transport belt 67 using the belt cleaning device 71.

In the above mode, however, a transfer bias applied to one of serial transfer rollers which is disposed upstream from each corresponding detection position where the surface potential of each corresponding regular separated-toner-image is to be detected, cannot be adjusted in response to the detection of the surface potential of each corresponding separated-toner-image performed at the above detection position.

In the above mode, a transfer bias applied to one of serial transfer rollers which is disposed downstream from the above detection position can be adjusted in response to the detection of the surface potential performed at the detection position.

In the above mode, for example, immediately after a preceding regular separated-toner-image having the yellow color has been transferred to a sheet 3 of paper, the surface potential of the preceding separated-toner-image is detected. Subsequently, based on the detected surface potential, the transfer bias applied to a transfer roller of a magenta processing device disposed corresponding to a subsequent regular separated-toner-image having the magenta color is regulated.

In the above example, a transfer bias to be applied to a transfer roller of a yellow processing device disposed for forming the preceding yellow-color separated-toner-image may be set to a predetermined fixed value.

In the above example, alternatively, the transfer bias is preferably applied to the above-described transfer roller of the yellow processing device at a level which has been appropriately adjusted based on the surface potential of a yellow-color toner-image detected in the previous cycle of the image forming process for creating a composite-toner-image separate from a current composite-toner-image.

Figure 7:
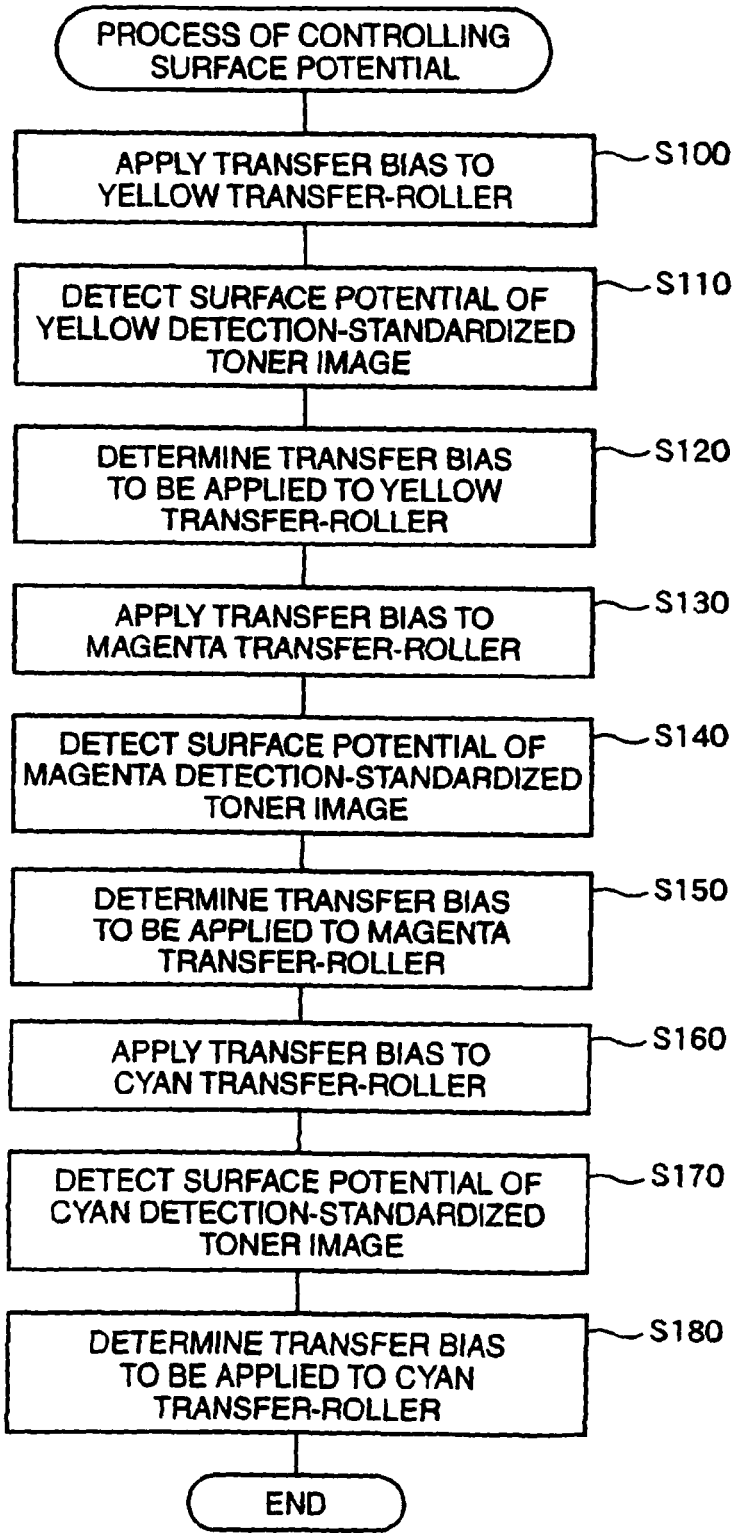
FIG. 7 is a flow chart illustrating a surface-potential control program to be executed by a computer within a controller indicated in FIG. 6.

In the surface potential control program shown in FIG. 7, the steps S100, S130, and S160 are each implemented to apply the transfer bias to each corresponding transfer roller 68 at a predetermined fixed level.

Alternatively, the present invention may be practiced such that the transfer bias is applied during a current cycle of the image forming process at a level which has been determined as a result of the implementation of the surface potential control during the previous cycle of the image forming process, wherein the level is the same as a level at which the transfer bias was actually applied when a toner image was transferred to a sheet of paper during the previous cycle of the image forming process.

In the above arrangement, the level of the transfer bias to be applied during the following cycle of the image forming process may be determined based on both the level of the transfer bias actually applied and the detected surface potential of a toner image during the current cycle of the image forming process.

As described above, the color laser printer 200 according to the second embodiment of the present invention is configured so as to sequentially perform the surface potential control on a page-by-page printing process basis. The present invention, however, may be practiced in alternative modes.

According to one of the above alternative modes, the surface potential control is performed at a limited time such as the time that the color laser printer 200 is powered on. This mode would be more advantageous in saving toner used, etc.

There will be described a color laser printer according to a third embodiment of the present invention.

Figure 8:
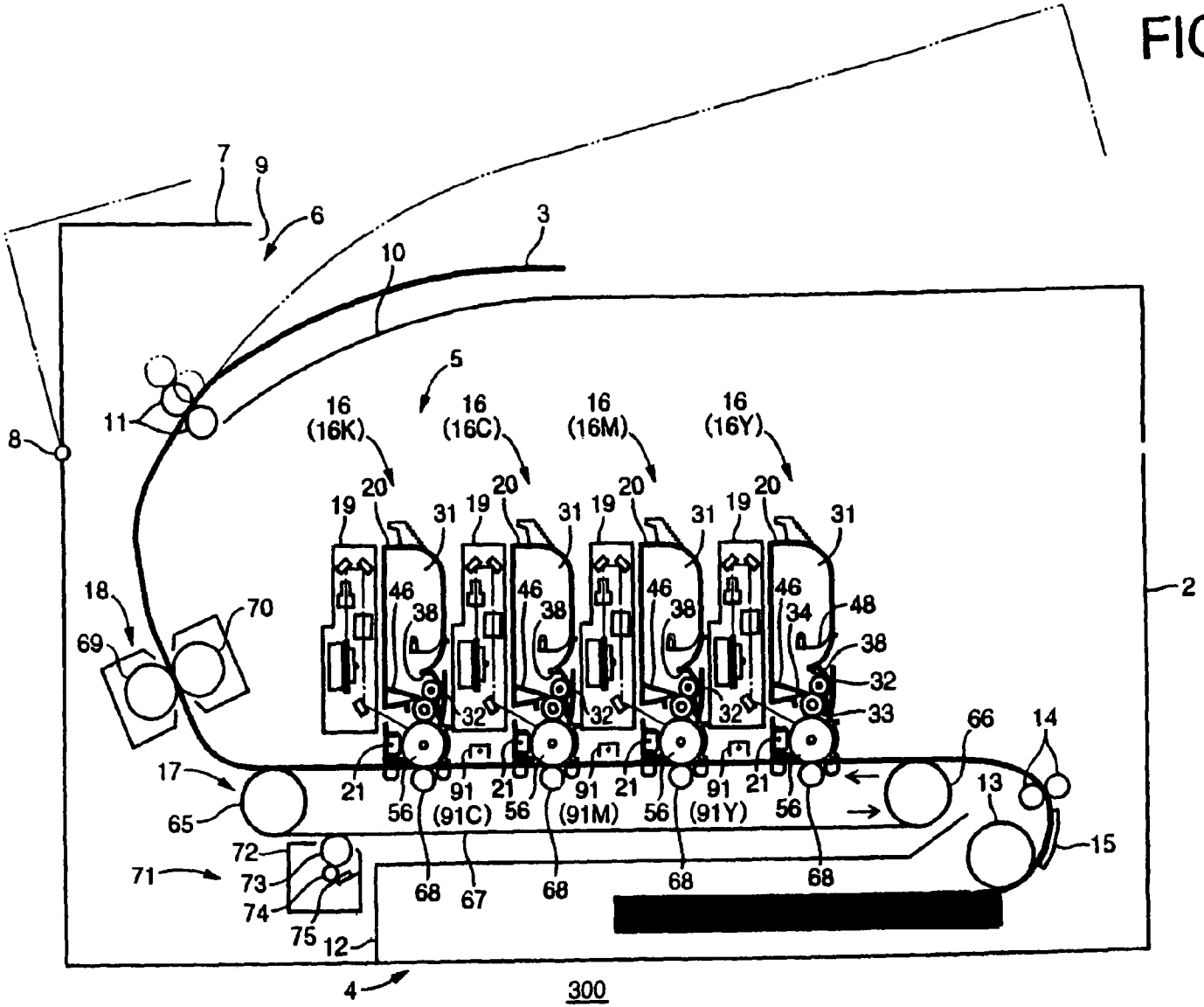
FIG. 8 is a cross-sectional side view illustrating a relevant portion of a color laser printer according to a third embodiment of the present invention.

FIG. 8 shows a relevant portion of a color laser printer 300 according to the present embodiment in a side cross-sectional view. As shown in FIG. 8, the color laser printer 300, as compared with the color laser printer 100 according to the aforementioned first embodiment (shown in FIG. 1), differs in that the color laser printer 300 includes the constitution for reducing the charge amount of the toner image which has been transferred onto a sheet 3 of paper (such as a charger 91 as described below).

Then, there will be described in more detail the color laser printer 300 including the elements common to those of the color laser printer 100 shown in FIG. 1, which elements will be referenced in FIG. 8 the same reference numerals those as in FIG. 1 instead of describing these elements in more detail.

As shown in FIG. 8, the color laser printer 300 according to the present embodiment includes three chargers 91Y, 91M, and 91C all of which are provided for reducing the charge amount of the toner image which has been transferred onto a sheet 3 of paper. Each charger 91 is disposed so as to be spaced apart a predetermined distance from the transport belt 67 in the vertical direction in non-contact relationship with the toner image on the sheet 3 transported via the transport belt 67.

Figure 9:
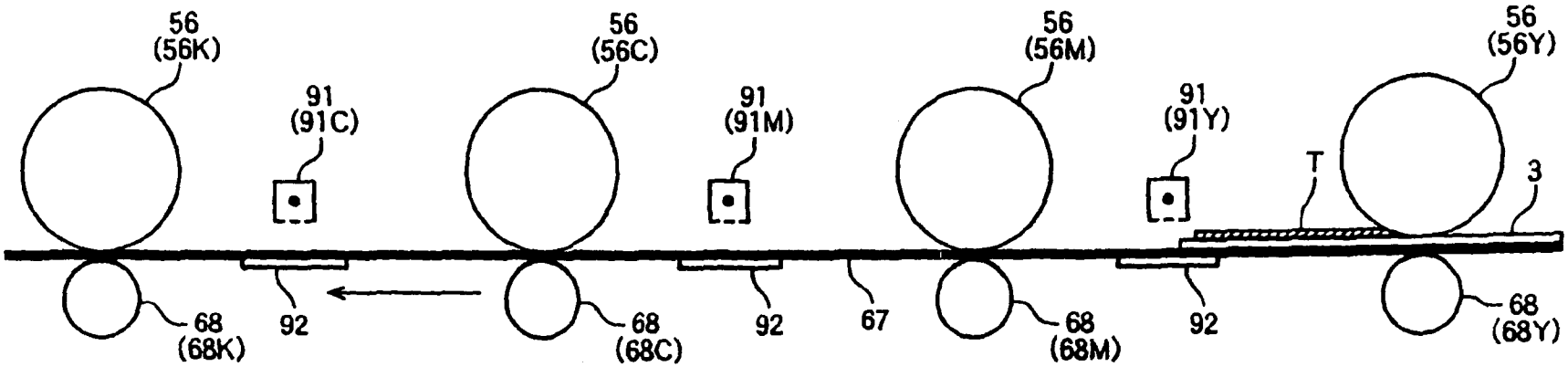
FIG. 9 is a side view illustrating the arrangement of chargers indicated in FIG. 8.

Specifically, as shown also in FIG. 9, the charger 91Y is disposed between the yellow processing device 16Y and the magenta processing device 16M, and is utilized for reducing the charge amount of the toner image T on the sheet 3 after the yellow toner-image T has been transferred to the sheet 3 by means of the photoconductive drum 56Y of the yellow processing device 16Y.

The charger 91M is disposed between the magenta processing device 16M and the cyan processing device 16C, and is utilized for reducing the charge amount of the toner image T on the sheet 3 after the magenta toner-image T has been transferred to the sheet 3 by means of the photoconductive drum 56M of the magenta processing device 16M.

The charger 91C is disposed between the cyan processing device 16C and the black processing device 16K, and is utilized for reducing the charge amount of the toner image T on the sheet 3 after the cyan toner-image T has been transferred to the sheet 3 by means of the photoconductive drum 56C of the cyan processing device 16C.

That is to say, the color laser printer 300 is configured, such that the chargers 91 reduce the charge amount of the toner image T on the sheet 3 on which a part of four single-color separated-toner-images to be finally transferred onto the sheet 3 has been previously transferred thereto, wherein the charge amount of the toner image T means the charge amount of the toner image T on the sheet 3 before contacting one of the photoconductive drums 56 which is subsequently operated.

Figure 10:
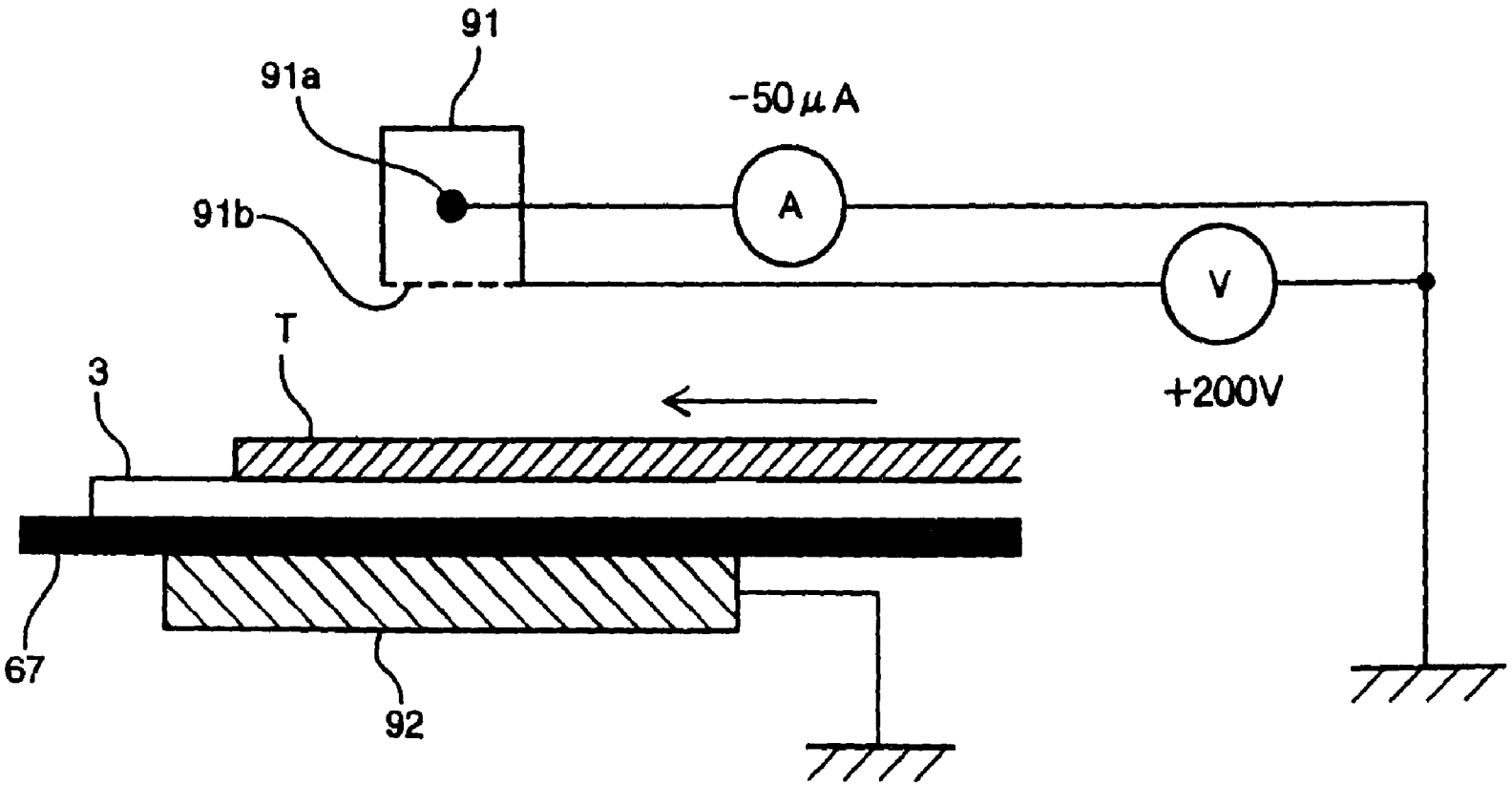
FIG. 10 is a view illustrating a representing one of the chargers indicated in FIG. 9 together with its peripheral components.

As shown in FIG. 10, there is provided as a charger 91*a* charger of the scorotron-type (scorotron-type charger) which includes a corona wire 91*a* as an ion generation electrode; and a grid electrode 91*b* as a potential adjustment electrode. A metal plate 92 (grounded) is disposed in the form of an opposed electrode to each corresponding charger 91, on one of both sides separated by the transport belt 67 which is opposite to the position of each corresponding charger 91.

A bias is applied to the corona wire 91*a* which has a polarity (in the present embodiment, a negative polarity) opposite to that of the toner image T on the sheet 3. In the present embodiment, the current of −50 μA is caused to flow in the corona wire 91*a*. On the other hand, a bias is applied to the grid electrode 91*b* which has a polarity (in the present embodiment, a positive polarity) similar to that of the toner image T on the sheet 3. In the present embodiment, the voltage of +200 volts is applied to the grid electrode 91*b*. As a result, the surface potential of the toner image T on the sheet 3 is caused to be reduced to the vicinity of the same level at +200 volts that the bias has been applied to the grid electrode 91*b* (+200 volts).

As a result, even if the charge amount of the toner image T which has been transferred onto a sheet 3 of paper is raised in the charge amount, i.e., the surface potential when the sheet 3 passes near one of the photoconductive drum 56, the corresponding one of the chargers 91 reduces the surface potential of the toner image T on the sheet 3 to a value suitable for suppressing a reverse transfer of the toner image T when the sheet 3 is fed to the subsequent one of the photoconductive drums 56.

In the present embodiment, each charger 91 has been adapted so as to generate ions by the use of what is called "wire electric discharge" by employing the corona wire 91*a* as an ion generation electrode. However, each charger evidently may be replaced with an alternative charger of the corona discharge type in which the ion generation electrode is made of a member other than a wire, and in which the potential adjustment electrode is made of a member other than a grid electrode.

In the color laser printer 300 according to the present embodiment, the scanner unit 19 constitutes an example of the aforementioned latent-image forming device, the developer unit 20 constitutes an example of the aforementioned developer unit, the photoconductive drum 56 constitutes an example of the aforementioned photoconductor, and the charger 91 constitutes an example of the aforementioned charge amount adjuster.

As is evident from the above description, the color laser printer 300 according to the present embodiment would offer basically the same advantages as the first and second advantages, as described above, offered by the color laser printer 100 according to the above-described first embodiment of the present invention. As described above in more detail, the first advantage is the prevention of deterioration in image quality, and the second advantage is the suppression of unintended mix of toner colors.

Further, the color laser printer 300 is configured such that a bias is applied to the corona wire 91*a* which has an polarity opposite to that of the toner image T, while a bias is applied to the grid electrode 91*b* which has an polarity similar to that of the toner image T. As a result, the color laser printer 300 would allow the charge amount of the toner image T on a sheet 3 of paper to be reduced to a suitable value without varying the polarity of the toner image T on the sheet 3.

As described above, the color laser printer 300 according to the above-described third embodiment of the present invention is adapted so as to bias the chargers 91 respectively to the same bias potential. The present invention, however, may be practiced in alternative modes.

For example, the present invention may be practiced in a mode that the charge amount of the toner image (superimposed toner image) T is reduced as the toner image T on the sheet 3 advances along the travel path of the sheet from the upstream to the downstream.

Further, when the present invention is practiced, the number of the chargers 91 is not limited to three, and it may be two or one. In the latter case, at least one charger 91 is preferably disposed at the downstream extreme one of successive positions of a sheet 3 of paper taken along the travel path. The surface potential of the toner image T is maximized at the downstream extreme position which, more specifically, is located between the cyan processing device 16C and the black processing device 16K.

There will be described a color laser printer according to a fourth embodiment of the present invention.

Figure 11:
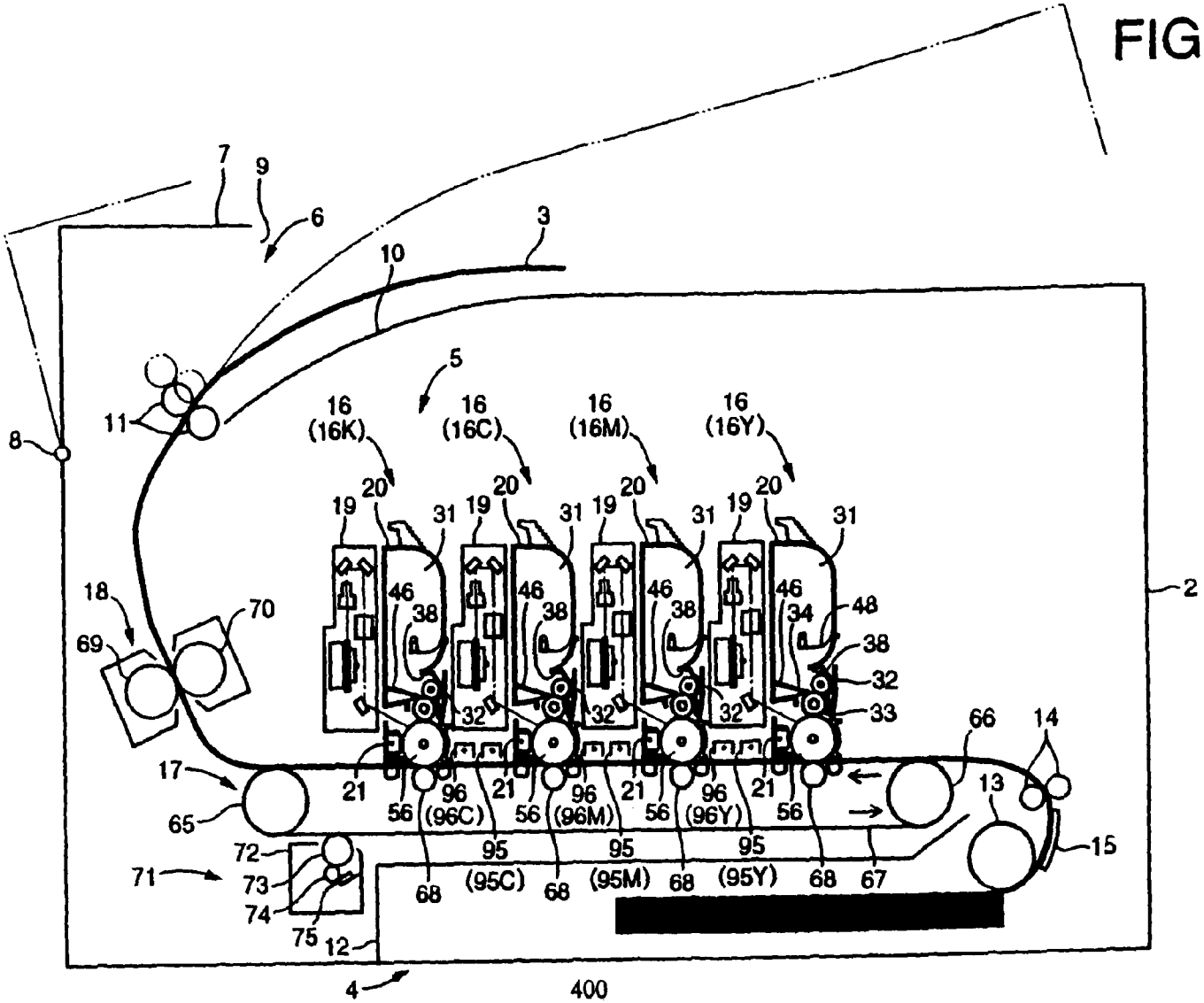
FIG. 11 is a cross-sectional side view illustrating a relevant portion of a color laser printer according to a fourth embodiment of the present invention.

FIG. 11 shows a relevant portion of a color laser printer 400 according to the present embodiment in a side cross-sectional view. As shown in FIG. 11, the color laser printer 400, as compared with the color laser printer 300 according to the aforementioned third embodiment (shown in FIG. 8), differs in that the color laser printer 400 includes a discharger 95 instead of each charger 91 (a corotron-type charger for generating negative ions), and a charger 96 (a corotron-type charger for generating positive ions).

Then, there will be described in more detail the color laser printer 400 including the elements common to those of the color laser printer 300 shown in FIG. 8, which elements will be referenced in FIG. 11 the same reference numerals those as in FIG. 8, instead of describing these elements in more detail.

As shown in FIG. 11, the color laser printer 400 according to the present embodiment includes three dischargers 95Y, 95M, and 95C all of which are provided for discharging the toner image that has been transferred onto a sheet 3 of paper; and three charger 96Y, 96M, and 96C all of which are provided for charging the toner image that has been transferred onto the sheet 3 of paper. The dischargers 95 and the chargers 96 are each disposed so as to be spaced apart a predetermined distance from the transport belt 67 in the vertical direction in non-contact relationship with the toner image on the sheet 3 transported via the transport belt 67.

Figure 12:
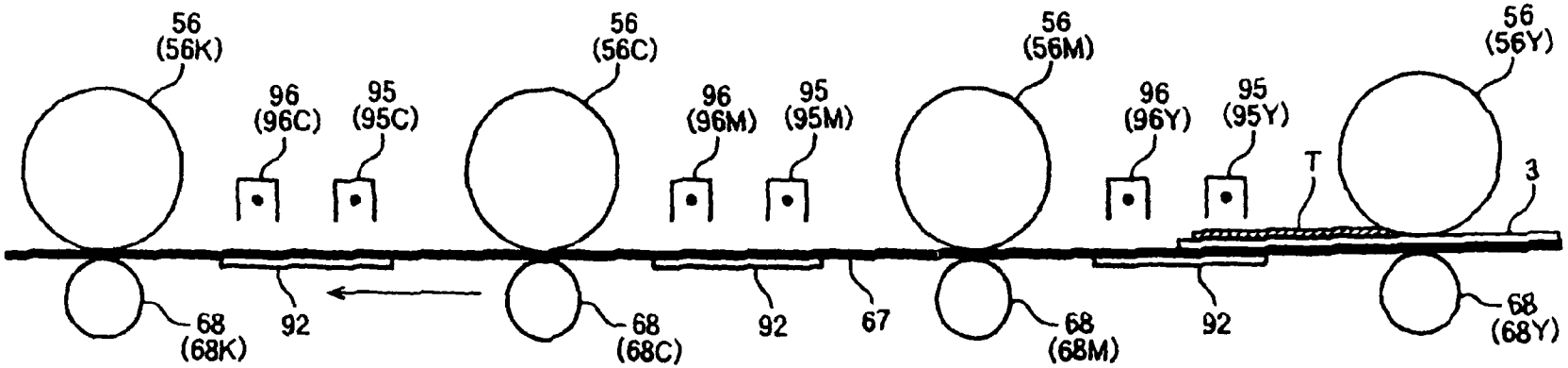
FIG. 12 is a side view illustrating the arrangement of dischargers and chargers indicated in FIG. 11.

Specifically, as shown also in FIG. 12, the discharger 95Y and the charger 96Y are disposed between the yellow processing device 16Y and the magenta processing device 16M. The discharger 95Y is utilized for discharging the toner image T on the sheet 3 after the yellow toner-image T has been transferred to the sheet 3 by means of the photoconductive drum 56Y of the yellow processing device 16Y. The charger 96Y is utilized for charging the toner image T which has been discharged by means of the discharger 95Y.

The discharger 95M and the charger 96M are disposed between the magenta processing device 16M and the cyan processing device 16C. The discharger 95M is utilized for discharging the toner image T on the sheet 3 after the magenta toner-image T has been transferred to the sheet 3 by means of the photoconductive drum 56M of the magenta processing device 16M. The charger 96M is utilized for charging the toner image T which has been discharged by means of the discharger 95M.

The discharger 95C and the charger 96C are disposed between the cyan processing device 16C and the black processing device 16K. The discharger 95C is utilized for discharging the toner image T on the sheet after the cyan toner-image T has been transferred to the sheet 3 by means of the photoconductive drum 56C of the cyan processing device 16C. The charger 96C is utilized for charging the toner image T which has been discharged by means of the discharger 95C.

The color laser printer 400 is configured, such that the discharger 95 discharges the toner image T on the sheet 3 on which a part of four single-color separated-toner-images to be finally transferred onto the sheet 3 has been previously transferred onto the sheet 3, wherein the toner image T means the toner image on the sheet 3 before contacting one of the photoconductive drum 56 which is subsequently operated, and such that, after the discharging by the discharger 95, the charger 96 charges the toner image T on the sheet 3, so that the charge amount of the toner image T has a polarity (a positive polarity in the present embodiment) similar to that of the toner image T before discharged, and has a magnitude (for enabling the surface potential to become lower than before the discharging, in the present embodiment) smaller than before charged, resulting in a reduced charge amount of the toner image T.

As a result, even if the charge amount of the toner image T which has been transferred onto a sheet 3 of paper is raised in the charge amount, i.e., the surface potential while when the sheet 3 passes near one of the photoconductive drums 56, the corresponding one of the dischargers 95 and the chargers 96 reduce the surface potential of the toner image T on the sheet 3 to an appropriate value when the sheet 3 is fed to the subsequent one of the photoconductive drums 56.

In the color laser printer 400 according to the present embodiment, the scanner unit 19 constitutes an example of the aforementioned latent-image forming device, the developer unit 20 constitutes an example of the aforementioned developer unit, the photoconductive drum 56 constitutes the aforementioned photoconductor, and the discharger 95 and the charger 96 together constitute an example of the aforementioned charge amount adjuster.

As is evident from the above description, the color laser printer 400 according to the present embodiment would offer basically the same advantages as the first and second advantages, as described above, offered by the color laser printer 100 according to the above-described first embodiment of the present invention. As described above in more detail, the first advantage is the prevention of deterioration in image quality, and the second advantage is the suppression of unintended mix of toner colors.

As described above, the color laser printer 400 is configured, such that the toner image T on a sheet 3 of paper, after discharged by the discharger 95, is charged by the charger 96, to thereby reduce the charge amount of the toner image, resulting in the optimized and stabled amount of the reduction in the charge amount of the toner image T. If the toner image T is subjected to only discharge by the discharger 95, the charge amount of the toner image T tends to be excessively reduced. As opposed to this, the color laser printer 400 would prevent an over-reduced charge amount of the toner image T.

In addition, the color laser printer 400 would also allow the restoration of the polarity of the toner which has been oppositely (negatively) charge to an appropriate (positive) polarity.

Still further, a case may exist where there are different from each other in charge amount between a toner image which has been transferred from the photoconductive drum 56Y of the yellow processing device 16Y onto a sheet 3 of paper; and a toner image which has been transferred from the photoconductive drum 56M of the magenta processing device 16M onto the same sheet 3 in superimposed registration. Even in this case, the color laser printer 400 is operated, such that each respective toner image, once discharged, is then charged, to thereby equalize the charge amount between these toner images.

The discharger 95 and the charger 96 are not each limited in type to the corotron type, and each may replace it with the scorotron type. The discharger 95 may be modified so as to perform the discharge by application of alternate voltage.

The charge amounts generated by the respective chargers 96 may be equal to each other, and alternatively, these charge amounts may be reduced as the toner image T on the sheet 3 advances along the travel path of the sheet 3 from the upstream to the downstream.

When the present invention is practiced, the number of the dischargers 95 and the number of the chargers 96 are not each limited to three, and each number may be two or one, for example. In this example, at least one discharger 95 and at least one charger 96 is preferably disposed at a downstream extreme one of successive positions of a sheet 3 of paper taken along the travel path, at which the surface potential of the toner image T is maximized. More particularly, the downstream extreme position is located between the cyan processing device 16C and the black processing device 16K.

While the above description covered the several embodiments of the present invention, it is readily understood that the invention evidently may be practiced in various alternative modes.

The above-described several embodiments of the present invention each has been configured in the form of a color laser printer of the tandem type for allowing a direct transfer process in which a toner image is successively transferred from each photoconductive drum 56 directly to a sheet 3 of paper. However, the configuration is for illustrative purposes and is not limiting.

For example, the present invention may be practiced in the form of a color laser printer of the tandem type for allowing an intermediate transfer process in which respective single-color toner images are firstly transferred sequentially from each corresponding photoconductor to an intermediate transfer belt functioning as the aforementioned image transferred medium, and are subsequently transferred at a time from the intermediate transfer belt to a sheet of paper.

In the case where the color laser printer 200 according to the second embodiment of the present invention is constructed to be of the tandem type for allowing the above intermediate transfer process, the aforementioned detection-standardized toner image may be transferred onto the intermediate transfer belt at a position other than a transfer position allowing the transfer of the single-color toner-images to the intermediate transfer belt, preferably at a position spaced apart forwardly from the transferred toner-image along the advancing direction of the intermediate transfer belt.

Further, a color laser printer constructed according to the present invention is not limited to be of the tandem type, and may be of, for example, the type generally referred to in the art as "four-cycle type."

This type of color laser printer is operated, such that single-color toner images different in color are sequentially formed on a unitary photoconductive drum common to developer units storing toners for the respective single-color toner-images, and the thus formed single-color toner images are sequentially transferred in superimposed registration onto an image transferred medium, such as a sheet of paper and an intermediate transfer belt, resulting in a multi-color composite-toner-image formed on the image transferred medium.

The color laser printer 100 according to the above-described first embodiment and the color laser printer 200 according to the above-described second embodiment may be respectively combined with the charger 91 provided in the color laser printer 300 according to the above-described third embodiment, or the discharger 95 and the charger 96 provided in the color laser printer according to the above-described fourth embodiment.

Further to the above, in the case where the color laser printer 100 according to the first embodiment is combined with the charger 91 or both the discharger 95 and the charger 96, the color laser printer 100 may be configured so that the surface potential of a toner image on a sheet 3 of paper is more surely restricted to fall within a range for allowing suppression of the reverse transfer (e.g., not exceeding 250 volts).

The above configuration would not limit, in order to adjust the surface potential of the toner image on the sheet 3, each set value of each corresponding one of elements constituting the color laser printer 100, such as the value of a transfer bias and the level of the surface potential of the photoconductive drum 56, resulting in a more flexible system configuration.

On the other hand, in the case where the color laser printer 200 according to the second embodiment is combined with the charger 91 or both the discharger 95 and the charger 96, the color laser printer 100 may be configured, such that the charger 91 or both the discharger 95 and the charger 96 are controlled based on the surface potential detected by the measuring probe 81, to thereby more surely suppress the surface potential of a toner image on a sheet 3 of paper so as to fall within a range for allowing suppression of the reverse transfer (e.g., not exceeding 250 volts).

The above configuration would not limit, in order to adjust the surface potential of the toner image on the sheet 3, each set value of each corresponding one of elements constituting the color laser printer 100, such as the value of a transfer bias and the level of the surface potential of the photoconductive drum 56, resulting in a more flexible system configuration.

It is evidently understood by those skilled in the art that the color laser printers 100, 200, 300, and 400 respectively according to the first, second, third, and fourth embodiments each may be modified by reversing the polarity of each electrical components constituting each respective laser printer or a toner employed, still with the same effects as the unmodified corresponding laser printer.

Once the above modification is made, the sign of the surface potential which has been taken along the horizontal axis of the graphs shown in FIG. 3, for example, is changed. However, the trend exhibited by the graphs will remain unchanged.

While several embodiments of the present invention have been described above by reference to the drawings, such description is for illustrative purposes, and the present invention may be carried out in alternative embodiments in which various modifications or improvements may be made of the present invention in light of the teachings of those skilled in the art without departing from the spirit of the present invention.

What is claimed is:

1. An apparatus for forming a multi-color image, comprising:

a plurality of developer units that contain a plurality of single-color developer materials, respectively, the plurality of developer materials having respective different single colors;

a latent-image forming device that forms each latent image on a photoconductor, wherein the latent-image forming device comprises a plurality of forming units, the photoconductor comprises a plurality of photoconducting units, and each of the forming units and a corresponding one of the photoconducting units are used for a respective one of the developer units;

a developer-image forming device that visualizes the each latent image which has been previously formed on the photoconductor, uses each corresponding one of the plurality of developer materials that has been supplied from each corresponding one of the plurality of developer units, into each corresponding single-color separated-developer-image, and that electrically transfers in sequence the each single-color separated-developer-image which has been previously formed, from the photoconductor onto an image transferred medium onto which the each single-color separated-developer-image is to be sequentially transferred, for a superimposed registration of a plurality of single-color separated-developer-images, to thereby form a multi-color composite-developer-image on the image transferred medium;

a charge amount adjuster that reduces a charge amount of the previously-formed separated-developer-image subset which has been transferred onto the image transferred medium; and a controller that controls the charge amount adjuster for performing anti reverse-transfer control such that a surface potential of a previously-formed separated-developer-image subset of a plurality of single-color separated-developer-images which has been previously transferred onto the image transferred medium is reduced, prior to a subsequent transfer in which a remainder of the plurality of separated-developer-images is transferred onto the image transferred medium after a previous transfer of the previously-formed separated developer-image subset onto the image transferred medium, to thereby prevent a reverse transfer of a part of the each developer material on the image transferred medium from the image transferred medium onto the photoconductor at the subsequent transfer, wherein the controller is adapted to reduce the surface potential via the charge amount adjuster, to thereby perform the anti reverse-transfer control, the charge amount adjuster is of a corona discharge type including an ion generation electrode and a potential adjustment electrode in which a first bias is applied to the ion generation electrode, the first bias having a polarity opposite to that of the each separated-developer-image on the image transferred medium, while a second bias is applied to the potential adjustment electrode, the second bias having a polarity similar to that of the each separated-developer-image on the image transferred medium, the charger is disposed on a side of the photoconductor with respect to the image transferred medium, and a grounded metal plate is disposed on an opposite side to the side of the charger with respect to the image transferred medium.

2. The apparatus according to claim 1, further comprising a sensor for detecting the surface potential, wherein the controller controls the charger based on the surface potential detected by the sensor, to thereby adjust the surface potential.

* * * * *